US007861945B2

(12) United States Patent
Yasuda et al.

(10) Patent No.: US 7,861,945 B2
(45) Date of Patent: Jan. 4, 2011

(54) ROTARY SPRAYING HEAD TYPE PAINTING DEVICE

(75) Inventors: Shinichi Yasuda, Fujieda (JP); Satoru Morishige, Saitama (JP)

(73) Assignee: ABB K.K., Tokyo (JP)

( * ) Notice: Subject to any disclaimer, the term of this patent is extended or adjusted under 35 U.S.C. 154(b) by 353 days.

(21) Appl. No.: 12/090,302

(22) PCT Filed: Jan. 11, 2007

(86) PCT No.: PCT/JP2007/050628

§ 371 (c)(1),
(2), (4) Date: Apr. 15, 2008

(87) PCT Pub. No.: WO2007/083677

PCT Pub. Date: Jul. 26, 2007

(65) Prior Publication Data

US 2008/0277496 A1 Nov. 13, 2008

(30) Foreign Application Priority Data

Jan. 19, 2006 (JP) ..... 2006-011442

(51) Int. Cl.
*F23D 14/50* (2006.01)

(52) U.S. Cl. ..... 239/112; 239/223; 239/293

(58) Field of Classification Search ..... 239/112, 239/113, 116, 222.11, 223, 224, 263.1, 291, 239/29, 570, 700
See application file for complete search history.

(56) References Cited

U.S. PATENT DOCUMENTS 5,813,608 A * 9/1998 Yoshioka et al. ..... 239/110
5,894,993 A * 4/1999 Takayama et al. ..... 239/112
6,050,499 A * 4/2000 Takayama et al. ..... 239/112
6,217,944 B1 * 4/2001 Yoshida et al. ..... 427/401
6,230,994 B1 * 5/2001 Boerner et al. ..... 239/700
7,726,586 B2 * 6/2010 Murai et al. ..... 239/224
2003/0010841 A1 * 1/2003 Kon ..... 239/224
2005/0001077 A1 * 1/2005 Kon et al. ..... 239/700

FOREIGN PATENT DOCUMENTS

| | | |
|---|---|---|
| JP | 3 151071 | 6/1991 |
| JP | 8 112559 | 5/1996 |
| JP | 8 332415 | 12/1996 |
| JP | 10 156224 | 6/1998 |
| JP | 2002 186883 | 7/2002 |
| JP | 2005 58802 | 3/2005 |

* cited by examiner

*Primary Examiner*—Jason J Boeckmann
(74) *Attorney, Agent, or Firm*—Oblon, Spivak, McClelland, Maier & Neustadt, L.L.P.

(57) ABSTRACT

A first wash fluid discharging passage having an outlet end thereof opened to an outer peripheral surface is provided on a rotary atomizing head and positioned behind a paint reservoir. A second wash fluid discharging passage having an outlet end thereof opened to the paint reservoir is also provided on the rotary atomizing head positioned around a fore end of a paint tube. Also, a nozzle is provided at a fore outlet end of a wash fluid tube. The nozzle internally defines an annular chamber for pooling a wash fluid. The nozzle includes first and second outlet openings to spurt a wash fluid toward the first and second wash fluid discharging passages. Further, a check valve in the annular chamber of the nozzle prevents a reverse flow of a wash fluid.

5 Claims, 17 Drawing Sheets

ROTARY SPRAYING HEAD TYPE PAINTING DEVICE

TECHNICAL FIELD

This invention relates to a rotary atomizing head type coating apparatus suitable for use, for example, in painting vehicle bodies or the like.

BACKGROUND ART

Generally, rotary atomizing head type coating apparatuses have a rotary atomizing head mounted on a rotational shaft of an air motor. In rotary atomizing head type coating apparatuses of this sort, it has been known to provide a feed tube internally of the rotational shaft to supply paint or cleaning fluid toward a rotary atomizing head (e.g., see, for example, Japanese Patent Laid-Open No. H10-156224 and 2002-186883).

In the prior art as mentioned above, a rotary atomizing head is formed in a bell or a cup like shape, and composed of a main atomizer body (a main body of a rotary atomizing head) having a paint reservoir at the depth on a concave front side, and a paint spreading surface which paint is spread into the shape of a thin film in front of the paint reservoir, and a partition member located on the inner peripheral side of the main atomizer body to partition off the paint spreading surface from the paint reservoir and provided with paint outlet holes to let paint flow out onto the paint spreading surface from the paint reservoir.

Japanese Patent Laid-Open No. H10-156224 discloses a main body of a rotary atomizing head which is provided with a solvent passage to communicate a paint reservoir with an outer peripheral side of a main atomizer body, for the purpose of washing outer peripheral surfaces of the rotary atomizing head. However, in this case, there is a problem that part of paint in the paint reservoir flows into the solvent passage and then onto the outer peripheral side of the main atomizer body through the solvent passage.

In contrast, Japanese Patent Laid-Open No. H8-332415 and 2002-186883 disclose a main atomizer body having a solvent reservoir which is provided separately from the paint reservoir and located on the rear side of the paint reservoir for the purpose of pooling there a solvent (a wash fluid) like thinner. In this case, by way of a solvent passage, the solvent reservoir is communicated with the outer peripheral side of a main atomizer body, i.e., a main body of the rotary atomizing head. At the time of washing the rotary atomizing head, a solvent is fed to the solvent reservoir on the main atomizer body when the rotary atomizing head is put in high speed rotation. Under the influence of centrifugal force, the solvent in the solvent reservoir is urged to flow out onto the outer periphery of the main atomizer body through the solvent passage to wash outer peripheral surfaces of the main atomizer body.

By the way, in the case of the prior art rotary atomizing head type coating apparatus which has a solvent reservoir provided on a main atomizer body in addition to a paint reservoir, it is inevitable that the main atomizer body is increased in size to make it. Therefore, it is difficult to manufacture a compact coater unit for use in a narrow limited space, in addition to a problem that the rotary atomizing head becomes so complicated in construction as would incur a higher production cost.

Furthermore, a solvent in the solvent reservoir on the main atomizer body is supplied to the outer peripheral side of the main atomizer body under the influence of centrifugal force by the rotary atomizing head which is put in high speed rotation. Accordingly, when the rotary atomizing head is at a rest, it is difficult to wash outer peripheral surfaces of the main atomizer body because no centrifugal force acts on the solvent in the solvent reservoir.

DISCLOSURE OF THE INVENTION

In view of the above-discussed problems with the prior art, it is an object of the present invention to provide a rotary atomizing head type coating apparatus employing a rotary atomizing head which is reduced in size and production cost and which the outer peripheral side of the main atomizer body can be washed clean even when the rotary atomizing head is at a rest.

(1) In order to solve the above-discussed problems, according to the present invention, there is provided a rotary atomizing head type coating apparatus comprised of: a hollow rotational shaft driven by a motor; a main atomizer body of a bell or a cup shape having a mount base at a rear side to be mounted on the rotational shaft, a paint reservoir at the depth of a front side and a paint spreading surface provided in front side of the paint reservoir for spreading paint into the shape of a thin film; a partition member located on an inner peripheral side of the main atomizer body to partition off the paint reservoir from the paint spreading surface, and provided with paint outlet holes to let paint in the paint reservoir flow out therethrough toward the paint spreading surface; and a paint tube passed through the rotational shaft and having an outlet end opened into the paint reservoir to supply paint thereto.

The rotary atomizing head type coating apparatus according to the present invention is characterized in that: a first wash fluid discharging passage provided at said main atomizer body and having an inlet end opened at the rear side of said paint reservoir and an outlet end opened at a backside of said main atomizer body; a second wash fluid discharging passage provided at said main atomizer body and having an inlet end opened at the rear side of paint reservoir and an outlet end opened into said paint reservoir; a wash fluid tube extended side by side with the paint tube to supply a wash fluid toward the first wash fluid discharging passage and the second wash fluid discharging passage; and a distribution means provided at an outlet end of said wash fluid tube for distributing a wash fluid toward inlet ends of said first wash fluid discharging passage and said second wash fluid discharging passage.

As described above, a distribution means is provided at an outlet end of a wash fluid tube, so that an effluent wash fluid from the wash fluid tube can be distributed toward both of the first and the second wash fluid discharging passages. As a consequence, part of a wash fluid is spurted out through the first wash fluid discharging passage to wash outer peripheral surfaces of the main atomizer body. On the other hand, the remainder of the wash fluid is allowed to flow into the paint reservoir through the second wash fluid discharging passage and then spurted out through paint outlet holes to wash paint spreading surfaces and paint releasing edges.

Since a wash fluid is distributed to the first and the second wash fluid discharging passages by the distribution means, currents of the wash fluid can be spurted out onto the outer peripheral surface of the main atomizer body from the first wash fluid discharging passage by the pressure of the wash fluid itself. Therefore, there is no need for provide a wash fluid pooling space on a rotary atomizing head as in the prior art mentioned hereinbefore. It follows that the main atomizer body can be made smaller in size and simpler in construction to cut its production cost. Besides, since the wash fluid can be spurted out onto outer peripheral surfaces of the main atomizer body by its own pressure, it is possible to wash outer peripheral surfaces of the main atomizer body even when the rotary atomizing head is at rest.

(2) According to the present invention, the rotary atomizing head type coating apparatus may further comprising a partition wall on the main atomizer body to partition off the first wash fluid discharging passage from the paint reservoir; a paint tube receptacle hole provided in the partition wall to receive the paint tube therein; and the second wash fluid discharging passage being formed as an annular passage between the paint tube and the paint tube receptacle hole.

As mentioned above, a partition wall is provided on the main atomizer body to partition off the paint reservoir and the first wash fluid discharging passage, so that an effluent wash fluid from the wash fluid tube can be prevented from entirely flowing into the paint reservoir. Besides, a tube receptacle hole is provided in the partition wall in such a way as to form an annular passage around the paint tube and the tube receptacle hole for use as the second wash fluid discharging passage. Thus, a gap space is provided between the main atomizer body and the fixed paint tube, permitting to supply part of the wash fluid to the paint reservoir by the second wash fluid discharging passage.

(3) According to the present invention, preferably the wash fluid tube is provided coaxially around outer periphery of the paint tube; and the distribution means is located at a fore outlet end of the wash fluid tube and around outer periphery of the paint tube.

As mentioned above, the wash fluid tube is provided coaxially around the outer periphery of the paint tube, so that an effluent wash fluid coming out of the wash fluid tube is allowed to flow along the paint tube. At this time, by the distribution means which is located at the fore end of the wash fluid tube and around the outer periphery of the paint part tube, the wash fluid flowing along the paint tube can be divided into separate distributor fractions.

(4) According to the present invention, preferably the distribution means is constituted by a nozzle provided at an outlet end of the wash fluid tube and formed with an annular chamber around the paint tube to pool a wash fluid therein, first outlet openings provided in the nozzle at confronting positions relative to the first wash fluid discharging passage to let a wash fluid in the annular chamber flow out toward the first wash fluid discharging passage, and second outlet openings provided in the nozzle at confronting positions relative to the second wash fluid discharging passage to let a wash fluid in the annular chamber flow out toward the second wash fluid discharging passage; and a check valve is provided in the annular chamber of the nozzle to prevent a reverse flow of the wash fluid.

With the arrangements just described, a wash fluid pooled in the annular chamber of a nozzle can be spurted out through the first and the second outlet openings. At this time, since the first outlet openings which are located in confronting positions relative to the first wash fluid discharging passage, a wash fluid is spurted out toward the outer peripheral surfaces of the atomizer body through the first outlet openings and the first wash fluid discharging passage. On the other hand, since the second outlet openings are located in confronting positions relative to the second wash fluid discharging passage, a wash fluid is spurted into the paint reservoir through the second outlet openings and the second wash fluid discharging passage.

In addition, the check valve which is provided in the annular chamber of the nozzle to prevent a reverse flow of a wash fluid precludes possibilities of the wash fluid from leaking from the annular chamber and dripping on a work piece during a coating operation. Further, since the check valve can be opened by the pressure of the supplied wash fluid itself, the pressure within the annular chamber can be maintained at a sufficiently high level for letting the wash fluid spurt out through the first outlet openings in the nozzle. Therefore, the wash fluid can jump over a gap space between the nozzle and the first wash fluid discharging passage and flow into the latter in an assured manner.

(5) According to the present invention, a fore end portion of the paint tube is extended as far as the paint reservoir past the second wash fluid discharging passage; the nozzle is constituted by a peripheral wall portion positioned coaxially around outer periphery of the paint tube, and a lid portion provided at a fore end of the peripheral wall portion at the rear side of the second wash fluid discharging passage; the first outlet openings being provided in the peripheral wall portion; and the second outlet opening being provided in the lid portion.

Thus, a wash fluid which is spurted out from the first outlet opening is directed in a radially outward direction from the peripheral wall portion of the nozzle to run into the first wash fluid discharging passage. On the other hand, a wash fluid which is spurted out through the second outlet openings in the lid portion of the nozzle is allowed to flow along the paint tube and run into the second wash fluid discharging passage.

(6) According to the present invention, the check valve is preferably formed of an elastic material and adapted to normally close an outlet end of the wash fluid tube, and to open the outlet end through elastic deformation upon supply of a wash fluid.

The check valve which is formed of an elastic material as mentioned above is adapted to normally hold an outlet end of the wash fluid tube in a closed state, opening up the outlet end of the wash fluid tube through elastic deformation upon supply of a wash fluid. Thus, the check valve is opened and closed according to the pressure of a supplied wash fluid, maintaining the pressure in the paint reservoir at a sufficiently high level.

(7) According to the present invention, the check valve may be constituted by a lid member closing an outlet end of the wash fluid tube, and a biasing spring constantly acting to press the lid member against the outlet end of the wash fluid tube.

In this case, a fore outlet end of the wash fluid tube is normally closed by a lid member, opening up the outlet end of the wash fluid tube by deforming the lid member against the spring member upon supply of a wash fluid. Thus, the check valve is opened and closed according to the pressure of a supplied wash fluid, maintaining the pressure in the annular chamber at a sufficiently high level when the wash fluid had been supplied.

(8) According to the present invention, the first outlet openings are preferably arranged to have an axial measure smaller than an axial measure of the inlet opening of the first wash fluid discharging passage.

Thus, at the time of spurting out a wash fluid from the first outlet openings toward the first wash fluid discharging passage, for example, the wash fluid which is once diffused around the first outlet openings can admit the wash fluid into the widely opened inlet opening of the first wash fluid discharging passage in an assured manner. That is to say, the wash fluid which spurted out from the first outlet openings can be almost entirely supply to outer peripheral surfaces of the main atomizer body through the first wash fluid discharging passage.

(9) According to the present invention, preferably branch nozzles are attached to the first outlet openings, with a spout end of the nozzles projected into the inlet opening of the first wash fluid discharging passage.

With the arrangement just described, a wash fluid which is spurted out from the first outlet openings can be handed over to the first wash fluid discharging passage by the branch nozzles in an assured manner. That is to say, the wash fluid which spurted out from the first outlet openings can be almost entirely supply to the outer peripheral surfaces of the main atomizer body through the first wash fluid discharging passage.

(10) Further, according to the present invention, the distribution means is constituted by a fin wall member fitted on the paint tube to turn a flow direction of an effluent wash fluid from the wash fluid tube toward the first wash fluid discharging passage, and axial through holes bored in the fin wall member to conduct an effluent wash fluid from the wash fluid tube toward the second wash fluid discharging passage; and the wash fluid tube being provided with a check valve at an outlet end at a position behind the fin wall member to prevent a reverse flow of the wash fluid.

In this case, the distribution means is constituted by a fin wall member which is provided on the paint tube, and axial through holes bored through the fin wall member. Thus, by the fin wall member, part of an effluent wash fluid from the wash fluid tube can be turned toward the first wash fluid discharging passage. On the other hand, the remainder of the wash fluid can be supplied toward the second wash fluid discharging passage by way of the through holes.

Besides, a check valve is provided at an outlet end of the wash fluid tube at a position posterior to the fin wall member to prevent a reverse flow of the wash fluid. Therefore, for example, the wash fluid is prevented from leaking out of the wash fluid tube and dripping on a work piece during a paint coating operation. Furthermore, since the check valve can be opened by the pressure of the wash fluid itself, an effluent wash fluid coming out of the wash fluid tube can be hit against the fin wall member under a sufficiently high discharge pressure. That is to say, the wash fluid which has been turned toward the first wash fluid discharging passage from the fin wall member can jump over a gap space intervening between the fin wall member and the first wash fluid discharging passage. Thus, the wash fluid can be supplied to the first wash fluid discharging passage in an assured manner.

(11) According to the present invention, preferably the main atomizer body is provided with a partition wall to partition off the paint reservoir from the first wash fluid discharging passage; and the partition wall being provided with a recessed passage way on the back side thereof and in a radially outer position relative to the fin wall member thereby to guide a flow of a wash fluid toward the first wash fluid discharging passage after a turn along said fin wall member.

According to the present invention, a recessed passage way is provided on the back side of the partition wall in the main atomizer body. In this instance, a wash fluid which is hit against the partition wall after being turned by the fin wall member can be received in the recessed passage way. Therefore, the wash fluid is prevented from scatting around upon hitting the partition wall and the wash fluid received in the recessed passage way can be led to the first wash fluid discharging passage.

BEST MODE FOR CARRYING OUT THE INVENTION

Figure 1:
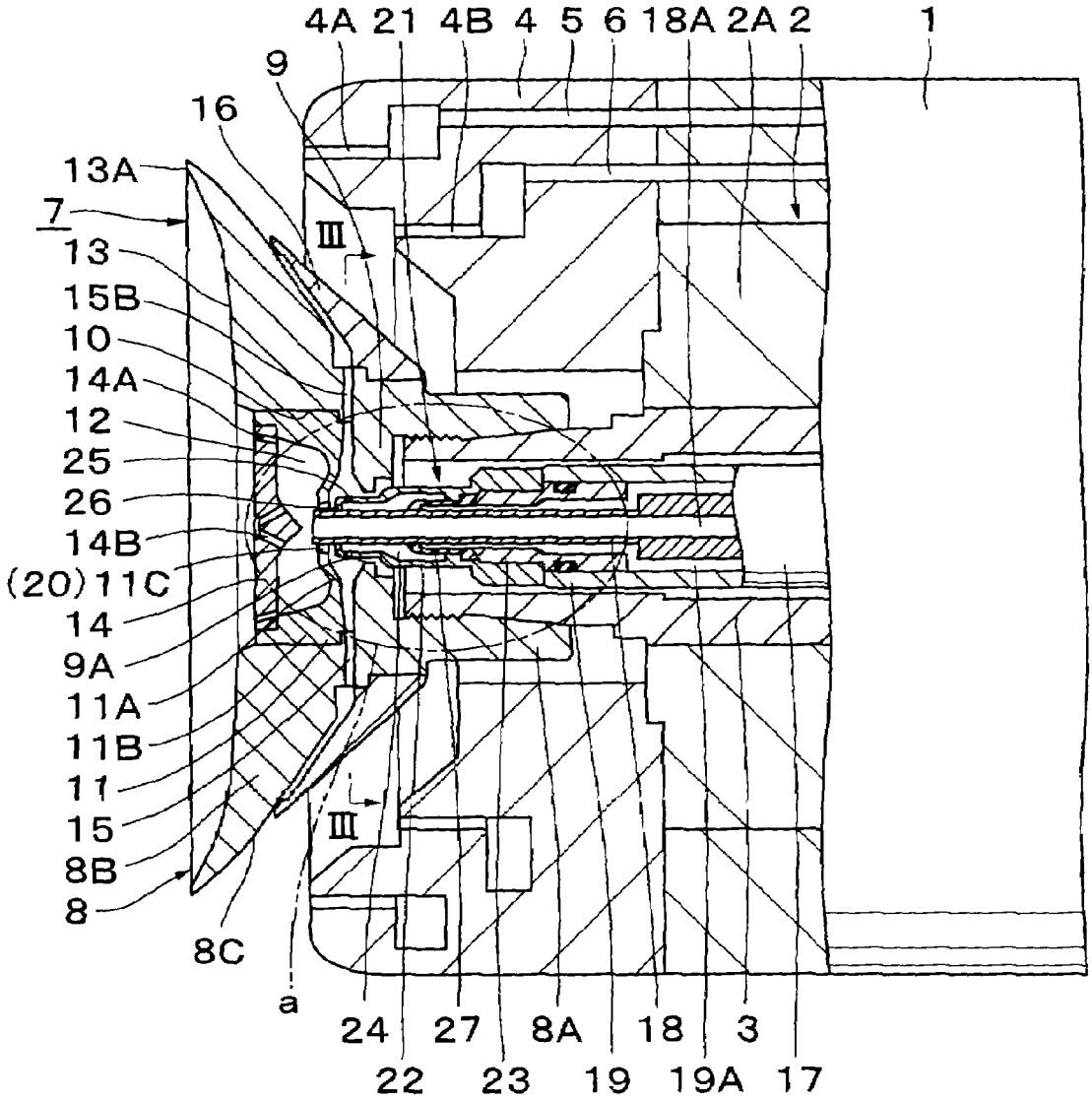
FIG. 1 is a longitudinal sectional view of a rotary atomizing head type coating apparatus according to a first embodiment of the present invention.

Hereafter, rotary atomizing head type coating apparatus according to the present invention is described more particularly by way of its preferred embodiments with reference to the accompanying drawings.

Referring first to FIGS. 1 through 5, there is shown a rotary atomizing head type coating apparatus according to a first embodiment of the present invention.

In these figures, indicated at 1 is a coater cover which is formed in a tubular shape to enshroud the outer periphery of the rotary atomizing head type coating apparatus, the coater cover 1 internally accommodating an air motor 2 which will be described hereinafter.

Indicated at 2 is an air motor which is accommodated in the coater cover 1. The air motor 2 is largely constituted by a tubular motor casing 2A, an air turbine which is accommodated in the motor casing 2A and a static air bearing serving to rotatably support a rotational shaft 3 which will be described hereinafter (both of the air turbine and static air bearing are not shown in the drawings). With supply of compressed air to the air turbine, the air motor 2 drives the rotational shaft 3 at a high speed of, for example, from 3,000 rpm to 150,000 rpm.

Denoted at 3 is a tubular (hollow) rotational shaft which is rotatably supported by the static air bearing of the air motor 2. A fore end portion of the rotational shaft 3 is projected on the front side of the air motor 2, and a rotary atomizing head 7 is threaded on a male screw which is tapped around the outer periphery of the projected fore end portion of the rotational shaft 3. Further, a base end portion of the rotational shaft 3 is securely fixed to the air turbine of the air motor 2.

Indicated at 4 is a shaping air ring which is attached to the fore end portion of the coater cover 1. This shaping air ring 4 is generally formed in a tubular shape and provided with a cone-shaped recess on the front side. Further, a large number of air outlet holes 4A (only two of which are shown in the drawing) are bored into the front end of the shaping air ring 4 in an outer peripheral side thereof. Each one of these air outlet holes 4A is connected to an air source (not shown) through a shaping air passage 5. Shaping air is spurted forward from these air outlet holes 4A thereby to control a spray pattern of paint particles which are sprayed by the rotary atomizing head 7 which will be described hereinafter.

Further, designated at 4B are a large number of diffusing air outlet holes (only two of which are shown in the drawing) which are provided in the shaping air ring 4, radially on the inner side of the air outlet holes 4A. These diffusing air outlet holes 4B are bored at intervals in the circumferential direction and located behind an outer peripheral surface 8C of a main atomizer body 8, which will be described hereinafter. Each one of the diffusing air outlet holes 4B is opened into an annular guide 16 at a position in the vicinity of an outer periphery of the latter which will be described hereinafter.

Through the diffusing air outlet holes 4B, diffusing air which is supplied through a diffusing air passage 6 from an air source is spurted out toward outer peripheral edge portions of the annular guide 16 from behind the main atomizer body 8. By the action of diffusing air, an effluent wash fluid from each wash fluid discharging passage 15 is spread into a film of a uniform thickness over the outer peripheral surface 8C of the main atomizer body 8 and guided toward the fore end of the outer peripheral surface 8C.

Indicated at 7 is a rotary atomizing head which is mounted on a fore end portion of the rotational shaft 3. As shown in FIG. 1, this rotary atomizing head 7 is largely constituted by a main atomizer body 8, an inwardly projecting collar 9, a paint reservoir 12, a paint spreading surface 13, a partition member 14, a first wash fluid outlet passage 15 and an annular guide 16 which will be described hereinafter.

Indicated at 8 is a main atomizer body of the rotary atomizing head 7 (a main structure of the rotary atomizing head), which is constituted by a hollow bell cup of a bell or a cup shape. The main atomizer body 8 is formed with a mount base 8A at its rear end, to fix the main atomizer body 8 on the rotational shaft 3, and with a forwardly spread or flared bell portion 8B on the front side. In this instance, the mount base 8A is formed in a tubular shape and provided with a female screw on a rear portion of its inner peripheral surface. The female screw is put in threaded engagement with the male screw which is provided on a fore end portion of the rotational shaft 3. When the mount base 8A is mounted at the fore end of the rotational shaft 3, the outer peripheral surface 8C of the flared bell portion 8B is positioned face to face with the inner peripheral side of the shaping air ring 4.

Indicated at 9 is an inwardly projecting collar which is formed on the main atomizer body 8. The inwardly projecting collar 9 is provided between the mount base 8A and the flared bell portion 8B and formed in the shape of an annular ring which is projected radially inward of the inner periphery of the main atomizer body 8. Further, a wash fluid outlet passage 15 is provided on the front side of the inwardly projecting collar 9 which will be described hereinafter. Furthermore, a nozzle fitting passage 9A is formed on the inner peripheral side (at the center) of the inwardly projecting collar 9 to receive a nozzle 22 at the fore distal end of a feed tube 17 which will be described later on.

Denoted at 10 is a positioning cavity which is provided on the main atomizer body 8. This positioning cavity 10 is located between the inwardly projecting collar 9 and the flared bell portion 8B, and opened to the front side of the flared bell portion 8B. The positioning cavity 10 serves to set in position an intermediate tube member 11 which will be described hereinafter.

Indicated at 11 is an intermediate tube member which is fitted in the positioning cavity 10 on the main atomizer body 8. This intermediate tube member 11 constitutes part of the main atomizer body 8. More specifically, the intermediate tube member 11 is located in an axially intermediate position on the main atomizer body 8, and formed in the shape of a bottomed tube having an annular wall portion 11A which partitions off a wash fluid outlet passage 15 from a paint reservoir 12 as a partition wall and a tubular portion 11B which is extended forward from an outer peripheral side of the annular wall portion 11A. In this instance, a tube receptacle hole 11C is opened on the inner side (at the center) of the annular wall portion 11A to receive a paint tube 18 of a feed tube 17 in small gap relation therewith. In the case of the particular embodiment shown, the tube receptacle hole 11C is formed in the shape of a tapered through hole with a gradually diminishing diameter from rear to front side. Further, the annular wall portion 11A is projected forward in its front center areas thereby to prevent intrusion of paint or of a wash fluid into the rotational shaft 3. The tubular portion 11B is provided with a guide surface 11D on its inner periphery to guide paint toward a paint outlet hole 14A (see FIGS. 2 and 5) which will be described hereinafter.

Indicated at 12 is a paint reservoir which is defined on the inner peripheral side of the intermediate tube member 11 between the annular wall portion 11A and a partition member 14 which will be described hereinafter. This paint reservoir 12 is a space in the shape of a deep dish, which is enclosed by intermediate tube portion 11, front side of the annular wall portion 11A, the guide surface 11D and rear side of a partition member 14. This paint reservoir 12 is a space for temporarily holding and diffusing paint or wash fluid which is discharged from a paint tube 18.

Designated at 13 is a paint spreading surface which is provided on the front side of the paint reservoir 12 toward the fore end of the main atomizer body 8. More particularly, this paint spreading surface 13 is formed on the inner peripheral side of the flared bell portion 8B of the main atomizer body 8 in a forwardly spread dish-like shape. Further, the fore end of the paint spreading surface 13 is terminated with paint releasing edges 13A where paint which has been spread into a thin film is released forward. Thus, paint flowing out of the paint reservoir 12 is spread into a thin film along the paint spreading surface 13 and sprayed forward from the paint releasing edges 13A in finely atomized particles.

Indicated at 14 is a partition member (a partition wall) which is attached to the intermediate tube member 11 in such a way as to close the front side of the latter. This partition member 14 is provided to partition off the paint spreading surface 13 on the inner periphery of the main atomizer body 8 from the paint reservoir 12. The partition member 14 constitutes part of the main atomizer body 8 along with the intermediate tube member 11. Further, the partition member 14 is formed substantially in the shape of a circular disc which closes an open end (a fore end) of the intermediate tube member 11 to define the paint reservoir 12 in the latter. In this instance, a large number of paint outlet holes 14A are provided at intervals along the outer periphery of the partition member 14 to let paint or a wash fluid flow out onto the paint spreading surface 13 on the main atomizer body 8. Furthermore, a plural number of center holes 14B (only two of which are shown in the drawing) are provided in a center region of the partition member 14 to let a wash fluid flow out to the front side.

Indicated at 15 is a first wash fluid discharging passage which is provided on the main atomizer body 8. As shown in FIG. 1, an inlet end of this first wash fluid discharging passage 15 is opened on the rear side of the paint reservoir 12 while its outlet end is opened to an outer peripheral surface 8C of the main atomizer body 8. In the case, the first wash fluid discharging passage 15 is in the form of an annular gap which is formed between the mount base 8A (the inwardly projecting collar 9) and the flared bell portion 8B (the intermediate tube member 11) of the rotary atomizing head 7.

Figure 2:
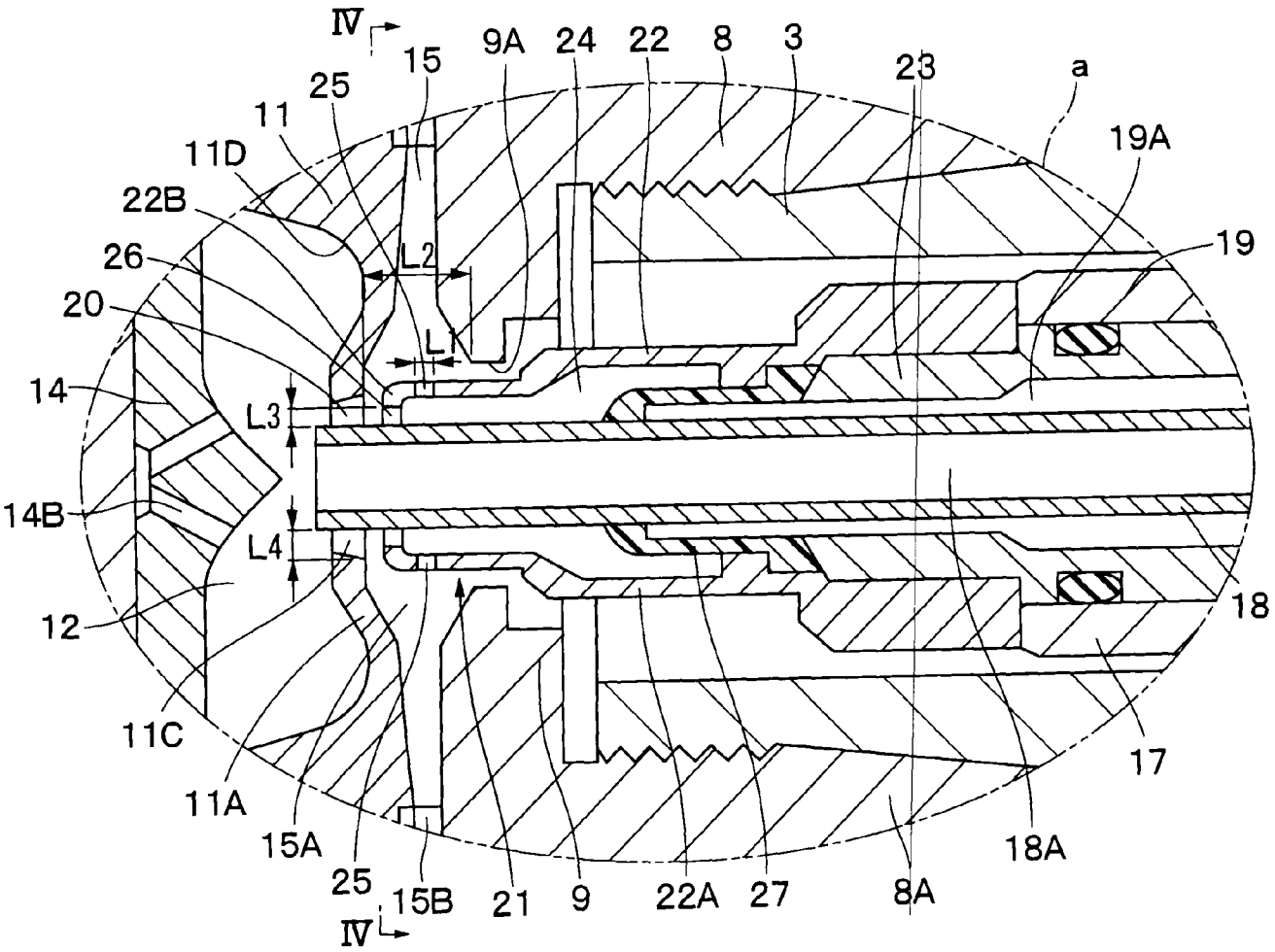
FIG. 2 is a longitudinal sectional view showing an encircled area a in FIG. 1 on an enlarged scale.

In this instance, as shown in FIG. 2, the inlet opening 15A of the wash fluid discharging passage 15 is formed in such a way as to surround a nozzle 22, which will be described hereinafter, and opened all around, with a gap width in the axial direction being gradually widened toward the inner open end (the inlet end) to present a tapered shape. In this manner, the inlet opening 15A of the wash fluid discharging passage 15 is so shaped as to receive a wash fluid from the nozzle 22 very easily. By the annular wall portion 11A, the wash fluid discharging passage 15 is partitioned from the paint reservoir 12 to let a wash fluid, which is supplied from a wash fluid tube 19, flow out onto an outer peripheral surface 8C of the main atomizer body 8.

Figure 3:
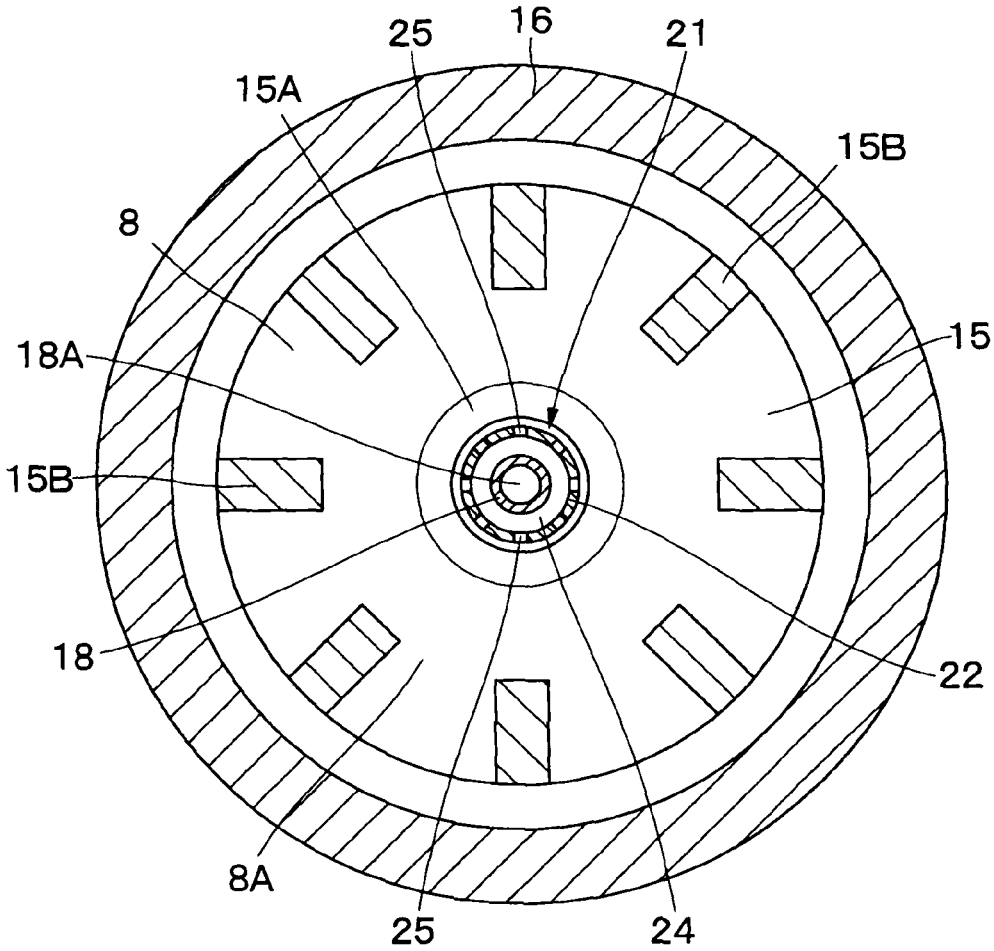
FIG. 3 is an enlarged cross-sectional view taken from the direction of arrows III-III of FIG. 1.

Further, as shown in FIG. 3, a plural number of support members 15B are provided at the outlet end of the wash fluid discharging passage 15, between the mount base 8A and flared bell portion 8B and in uniformly spaced positions in the circumferential direction. In this manner, by means of the support members 15B, a predetermined gap width in the axial direction in the main atomizer body 8 is secured for the wash fluid discharging passage 15.

Preferably, the support members 15B are provided only at the outlet end of the wash fluid discharging passage 15 and not at the inlet opening 15A. In a case where the support members 15B are provided only at the outflow ends of the wash fluid discharging passage 15 as in the first embodiment, a wash fluid which is spurted out through outlet opening 25 of a nozzle 22, which will be described hereinafter, can be passed to the wash fluid discharging passage 15 easily and smoothly without being splashed back by interference with the support members 15B.

Denoted at 16 is an annular guide which is attached to the outer peripheral side of the main atomizer body 8 in spaced position relative to the back side of the flared bell portion 8B. This annular guide 16 is inclined rearward in its inner peripheral side in conformity with an angle of inclination of the respective wash fluid discharging passage 15, and inclined forward in its outer peripheral side toward the outer peripheral surface 8C of the main atomizer body 8. By the annular guide 16, an effluent solvent which tends to scatter radially outward from each wash fluid discharging passage 15 is guided in a forward direction toward the outer peripheral surface 8C of the main atomizer body 8.

Indicated at 17 is a feed tube which is extended axially through the hollow rotational shaft 3. As shown in FIG. 2, this feed tube 17 is of a double tube construction, including an elongated paint tube 18 which is extended as far as the paint reservoir 12 of the rotary atomizing head 7 at its fore end beyond a second wash fluid discharging passage 20, which will be described hereinafter, and a shorter wash fluid tube 19 which is provided coaxially around the circumference of the paint tube 18 and its fore end terminated on the rear side of the paint reservoir 12.

In this instance, a paint supply passage 18A is provided internally of the paint tube 18 which serves to supply paint toward the rotary atomizing head 7 during a painting operation, and to supply a wash fluid such as a solvent or air therethrough at the time of a washing or cleaning operation. A paint valve (not shown) which is provided internally of the paint supply passage 18A is opened at the time of paint supply and closed to cut off paint supply. For example, the paint tube 18 is connected to a color changing valve assembly (not shown) through a pipe line and a valve.

Defined between the paint tube 18 and the wash fluid tube 19 is an annular space which serves as a wash fluid supply passage 19A to supply a wash fluid such as a solvent or air toward the rotary atomizing head 7. For example, the wash fluid tube 19 is connected to a wash fluid supply source (not shown) through a pipe line and a valve.

Designated at 20 is a second wash fluid discharging passage which is provided in the intermediate tube member 11 of the main atomizer body 8. This second wash fluid discharging passage 20 is in the form of an annular passage which is defined between outer periphery of the paint tube 18 and the tube receptacle hole 11C. An inlet end of the wash fluid discharging passage 20 is opened to the rear side of the intermediate tube member 11 (toward the inlet opening 15A of the first wash fluid discharging passage 15). Namely, the wash fluid discharging passage 20 has an inlet end opened to the rear side of the paint reservoir 12 and has an outlet end opened into the paint reservoir 12. Further, the wash fluid discharging passage 20 is formed in a tapered shape getting gradually narrower from its inlet to outlet end.

Indicated at 21 is a distribution means which is provided at the outlet end of the wash fluid tube 19. This distribution means 21 is constituted by a nozzle 22 and first and second outlet openings 25 and 26, which will be described hereinafter. By the distribution means 21, a flow of a wash fluid is divided toward the inlet end of the first and second wash fluid discharging passages 15 and 20.

Denoted at 22 is a nozzle which is provided at a fore distal end of the wash fluid tube 19. As shown in FIG. 2, the nozzle 22 is formed substantially in a tubular shape and located in such a way as to circumvent the outer periphery of the paint tube 18. This nozzle 22 is attached to the fore end of the wash fluid tube 19 by the use of a connector member 23.

In this instance, the nozzle 22 is composed of a tubular outer peripheral wall 22A which is extended along the paint tube 18 and a lid portion 22B which is provided on the fore end of the outer peripheral wall 22A and extended radially inward of the paint tube 18. In the particular embodiment shown, the outer peripheral wall 22A is located coaxially around the outer periphery of the paint tube 18. On the other hand, the lid portion 22B is located behind the second wash fluid discharging passage 20. Further, by and between the outer peripheral wall 22A and the paint tube 18, an annular chamber 24 is defined internally of the nozzle 22. This annular chamber 24 is communicated with the wash fluid tube 19

(the wash fluid supply passage 19A) to serve as a wash fluid reservoir for holding a wash fluid.

Moreover, the nozzle 22 which is projected out of the fore end of the rotational shaft 9 is placed in a nozzle receptacle hole 9A in the inwardly projecting collar 9. The outer peripheral wall 22A of the nozzle 22 is extended as far as a radially confronting position relative to the inlet opening 15A of the wash fluid discharging passage 15. On the other hand, the lid portion 22B of the nozzle 22 is spaced by a gap from the annular wall portion 11A (from the tube receptacle hole 11C) of the intermediate tube member 11.

Indicated at 25 are first outlet openings which are provided in the nozzle 22 at positions confronting the inlet opening 15A of the first wash fluid discharging passage 15. As shown in FIGS. 2 and 3, the outlet openings 25 are in the form of through holes of a small diameter which are bored through the outer peripheral wall portion 22A. A plural number of outlet openings (e.g., eight outlet openings) 25 are bored at the same axial positions of the outer peripheral wall portion 22A. Namely, these outlet openings 25 are located at uniformly spaced angular positions around the outer peripheral wall portion 22A. Moreover, the outlet openings 25 have an axial measure L1 which is smaller than a measure L2 of inlet openings 15A of the wash fluid discharging passage 15. Through the outlet holes 25, a wash fluid in the annular chamber 24 is allowed to flow toward the wash fluid discharging passage 15.

Figure 4:
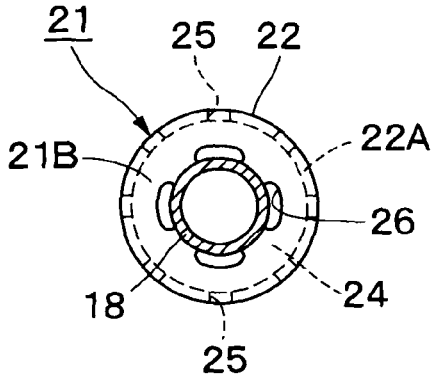
FIG. 4 is an enlarged cross-sectional view taken from the direction of arrows IV-IV of FIG. 2.

Indicated at 26 are second outlet openings which are provided in the nozzle 22 at axially confronting positions relative to the second wash fluid discharging passage 20. As shown in FIGS. 2 and 4, the outlet openings 26 are in the form of a through hole of a small diameter which is bored through the lid portion 22B. A plural number of outlet openings 26 (e.g., four outlet openings 26) are formed at the lid portion 22B which is in contact with the paint tube 18. The plural number of outlet openings 26 is formed in uniformly spaced positions around the outer periphery of the paint tube 18. Through these outlet openings 26, a wash fluid in the annular chamber 24 is allowed to flow out toward the second wash fluid discharging passage 20. As a result, a wash fluid which has flown out through the outlet openings 26 is allowed to flow along the outer periphery of the paint tube 18 and supplied to the paint reservoir 12 past the second wash fluid discharging passage 20.

In this instance, a radial measure L3, measured from the outer peripheral surface of the paint tube 18 to the outer peripheral end of the outlet opening 26, is smaller than a radial measure L4 measured from the outer peripheral surface of the paint tube 18 to the rear end (an inlet end) of the second wash fluid discharging passage 20.

Accordingly, as a wash fluid is spurted out from the second outlet opening 26 toward the wash fluid discharging passage 20, the wash fluid is allowed to flow into the wash fluid discharging passage 20 in an assured manner through the wide open inlet end of the latter. Thus, the wash fluid is supplied to the paint reservoir 12 through the wash fluid discharging passage 20 in an assured manner.

Denoted at 27 is a check valve which is provided within the annular chamber 24 of the nozzle 22 to prevent a reverse flow of a wash fluid. As shown in FIG. 2, the check valve 27 is located in such a way as to circumvent the paint tube 18 of the feed tube 17, and attached to an outlet end of the wash fluid tube 19 by the way of a fore end of the connector member 23 and outer peripheral wall portion 22A of the nozzle 22. Further, the check valve 27 is formed substantially in a round tubular shape by the use of an elastic material, for example, by the use of a fluorine-base synthetic resin.

In this instance, at the base end, the check valve 27 is communicated with the inner peripheral of the wash fluid tube 19 to admit a supply of a wash fluid. On the other hand, normally a fore distal end of the check valve 27 is resiliently abutted against an outer peripheral surface of the paint tube 18 to prevent leaks of a wash fluid. However, when a wash fluid is supplied through the wash fluid tube 19, through elastic deformation the fore end of the check valve 27 is pushed open away from the paint tube 18 by the pressure of the supplied wash fluid. Thus, the check valve 27 is normally closed and opened as soon as a wash fluid is supplied.

Being arranged as described above, the rotary atomizing head type coating apparatus of the present embodiment can be put in a paint coating operation and a washing operation in the manner as follows.

In the first place, for spraying a work piece with paint, a paint coating operation is carried out as follows. At the time of a paint coating operation, by the air motor 2 the rotary atomizing head 7 is put in high speed rotation together with the rotational shaft 3, for example, at a speed between 3,000 rpm and 150,000 rpm by the air motor 2. In this state, paint which is supplied via a color changing valve is fed to the paint reservoir 12 on the rotary atomizing head 7 through the paint tube 18, letting the paint undergo diffusion within the paint reservoir 12. The paint reservoir 12 is provided separately from the wash fluid discharging passage 15 and partitioned from the latter by the annular wall portion 11A of the intermediate tube member 11. Therefore the diffused paint in the paint reservoir 12 flows out onto the paint spreading surface 13 of the main atomizer body 8 through the paint outlet holes 14A in the partition member 14 without flowing into the wash fluid discharging passage 15. The paint is formed into a thin film on the paint spreading surface 13, and released from the paint releasing edges 13A in the form of finely divided particles.

At this time, a high voltage is applied, for example, to the rotary atomizing head 7, so that lines of electric force are formed between the rotary atomizing head 7 and a work piece which is connected to the earth ground. Therefore, paint particles sprayed forward by the rotary atomizing head 7 are urged to fly along the lines of electric force and deposit on the work piece. At this time, the spray pattern of paint particles is adjusted into a desired shape by means of shaping air which is spurted out through the respective shaping air outlet holes 4A of the shaping air ring 4.

Figure 5:
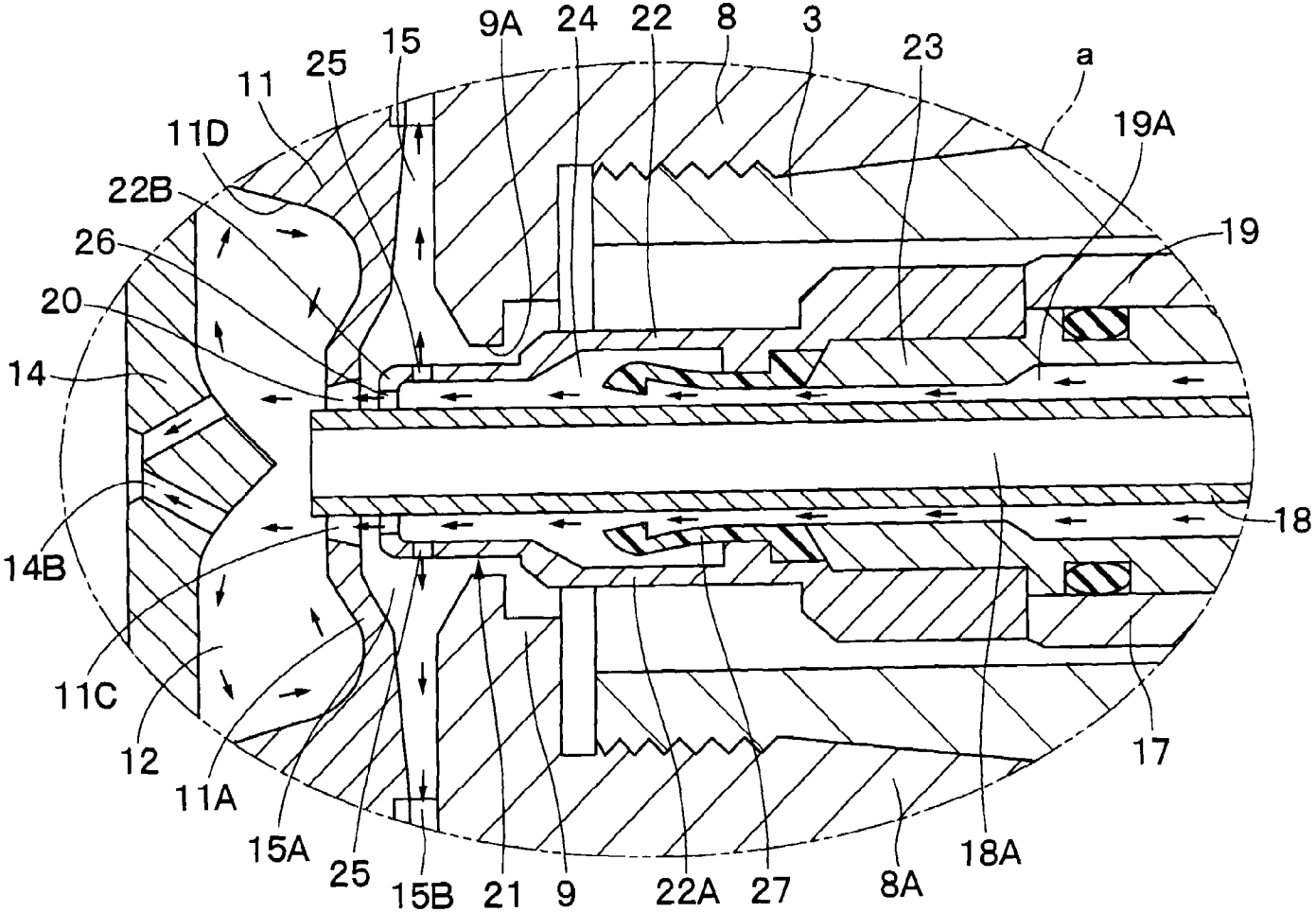
FIG. 5 is a longitudinal sectional view in a position similar to FIG. 2, showing a wash fluid in supply toward a rotary atomizing head.

Now, upon completion of a paint coating operation, the rotary atomizing head 7 is washed clean by a washing or cleaning operation as described below with reference to FIGS. 2 and 5.

In a case where paint of the same color is going to be used in a next paint coating operation, for example, it suffices to wash the rotary atomizing head 7 alone. In such a case, for washing the rotary atomizing head 7, a wash fluid such as a solvent or air is fed, through the wash fluid tube 19, to the rotary atomizing head 7 which is put in high speed rotation. Whereupon, the check valve 27 at the fore distal end of the wash fluid tube 19 is pushed open by the pressure of the wash fluid, so that the annular chamber 24 is filled with a wash fluid of a pressure which is high enough for opening the check valve 27. Thus, the wash fluid which has been admitted into the annular chamber 24 under pressure gushes out (spring out) through the first and second outlet openings 25 and 26.

At this time, since the first outlet openings 25 are located in radially confronting positions relative to the first wash fluid discharging passage 15, the wash fluid gushing out through the first outlet openings 25 flows into the inlet opening 15A of the wash fluid discharging passage 15, jumping over a gap space between the nozzle 22 and the wash fluid discharging passage 15. Under the influence of centrifugal force in addition to its own pressure, the wash fluid which has flowed into the wash fluid discharging passage 15 is urged to flow out onto the outer peripheral surface 8C of the main atomizer body 8. The wash fluid flowing out onto the outer peripheral surface 8C is caused to run between the outer peripheral surface 8C and the annular guide 16.

At this time, by the action of diffusing air which is spurted toward the outer peripheral surface 8C of the main atomizer body 8 from the diffusing air outlet holes 4B, the wash fluid which flows out from outer peripheral edges of the annular guide 16 is pushed against and spread over the entire outer peripheral surface 8C. As a result, paint deposits on the outer peripheral surface 8C of the main atomizer body 8 can be washed away completely by the wash fluid which is spread over the outer peripheral surface 8C in the form of films of uniform thickness.

On the other hand, since the second outlet openings 26 are located in confronting positions relative to the second wash fluid discharging passage 20, a wash fluid gushing out of the second outlet openings 26 is allowed to run along the paint tube 18 then through the wash fluid discharging passage 20 to flow into the paint reservoir 12. The wash fluid that has once flowed into the paint reservoir 12 flows out onto the paint spreading surface 13 on the main atomizer body 8 through the paint outlet holes 14A in the partition member 14 to wash away paint deposits therefrom. In this instance, since the paint reservoir 12 is isolated from the first wash fluid discharging passage 15, a wash fluid which has been contaminated by washing the paint reservoir 12 has no possibility of flowing to the side of the wash fluid discharging passage 15.

In case a paint color is to be changed, it is necessary to wash the paint tube 18 simultaneously with the rotary atomizing head 7 prior to a color change. Therefore, in such a case, a wash fluid is supplied to the paint tube 18 in addition to the wash fluid tube 19. A wash fluid supplied to the paint tube 18 is used not only for washing the paint tube 18 but also for washing a front side of the partition member 14 by currents flowing out through the center openings 14B of the partition member 14 and flowing toward and on the paint spreading surface 13.

Thus, according to the present embodiment, the nozzle 22 with the first and second outlet openings 25 and 26 is attached on the fore distal end of the feed tube 17. Therefore, a wash fluid which is discharged from the wash fluid tube 19 is filled in the annular chamber 24 within the nozzle 22 and spurted out through the first and second outlet openings 25 and 26. At this time, since the first outlet opening 25 are located in confronting positions relative to the first wash fluid discharging passage 15, part of the wash fluid is allowed to flow toward the wash fluid discharging passage 15 from the first outlet openings 25. As a result, the effluent wash fluid from the first outlet openings 25 is supplied to the outer peripheral surface 8C of the main atomizer body 8 via the wash fluid discharging passage 15 to wash the outer peripheral surface 8C.

On the other hand, since the second outlet openings 26 are located in confronting positions relative to the second wash fluid discharging passage 20, part of the wash fluid is allowed to flow out through the second outlet openings 26 and run along the paint tube 18 past the wash fluid discharging passage 20 for supply to the paint reservoir 12. Thus, the effluent wash fluid from the second outlet openings 26 is passed through the paint reservoir 12 and then spurted out through the paint outlet holes 14A to wash the paint spreading surface 13 and the paint releasing edges 13A.

The wash fluid tube 19 which is shorter than the paint tube 18 is located coaxially around the outer periphery of the latter. Therefore, the effluent wash fluid from the shorter wash fluid tube 19 is allowed to flow forward along the longer paint tube 18. At this time, since the nozzle 22 is mounted around the outer periphery of the paint tube 18, the wash fluid flowing along the paint tube 18 can be distributed to both of the first and second wash fluid discharging passages 15 and 20 through the first and second outlet openings 25 and 26 in the nozzle 22, respectively.

Namely, the first and the second outlet openings 25 and 26 distribute the wash fluid to the first and second wash fluid discharging passages 15 and 20 of the rotary atomizing head 7. Therefore, the wash fluid in the annular chamber 24 of the nozzle 22 can be spurted into the wash fluid discharging passages 15 and 20 by the use of the pressure of the wash fluid itself, letting the wash fluid flow vigorously on the outer peripheral surface 8C of the main atomizer body 8 and in the paint reservoir 12 as well. Thus, there is no need any longer for providing a wash fluid pooling space on the rotary atomizing head 7 as disclosed in Japanese Patent Laid-Open No. H8-332415 and 2002-186883 mentioned hereinbefore. That is to say, as compared with the prior art, the rotary atomizing head 7 can be provided in a more compact form and in a more simplified construction to cut its production cost. Furthermore, arrangements are made to let the wash fluid flow out onto the outer peripheral surface 8C of the main atomizer body 8 by its own pressure, making it possible to wash the outer peripheral surface 8C of the main atomizer body 8 even when the rotary atomizing head 7 is at a rest.

Further, the check valve 27 is provided within the annular chamber 24 of the nozzle 22 to prevent a reverse flow of the wash fluid. Therefore, for example, a coating operation can prevent leaks of the wash fluid from the annular chamber 24, which would drip on a work piece. Besides, since the check valve 27 can be opened by the pressure of the wash fluid, the pressure within the annular chamber 24 can be maintained at a level which is high enough for letting the wash fluid gush out (spring out) through the first outlet openings 25 and jump over a gap space between the nozzle 22 and the wash fluid discharging passage 15, supplying the wash fluid into the wash fluid discharging passage 15 in a secure and reliable manner.

Further, according to the present embodiment, the nozzle 22 is composed of the outer peripheral wall portion 22A which is provided coaxially around the outer periphery of the paint tube 18, and the lid portion 22B which is provided at a fore distal end of the outer peripheral wall portion 22A, having the first and second outlet openings 25 and 26 bored in the outer peripheral wall portion 22A and the lid portion 22B, respectively. Thus, a wash fluid flowing out of the first outlet openings 25 is directed in a radially outward direction from the outer peripheral wall portion 22A of the nozzle 22 to flow into the first wash fluid discharging passage 15. On the other hand, a wash fluid flowing out of the second outlet openings 26 is urged to flow along the paint tube 18 from the lid portion 22B of the nozzle 22 to flow into the second wash fluid discharging passage 20.

Further, the check valve 27 which is formed of an elastic material is adapted to normally close an outlet end of the wash fluid tube 19 and to open the outlet opening of the wash fluid tube 19 through elastic deformation as soon as a wash fluid is supplied thereto. That is to say, the check valve 27 is opened and closed according to the pressure of a supplied wash fluid, and is capable of maintain the internal pressure of the annular chamber 24 at a certain level.

Especially, in the case of the present embodiment, the first outlet openings 25 are arranged to have an axial measure L1 which is smaller than an axial measure L2 of inlet openings of the first wash fluid discharging passage 15. Therefore, a wash fluid which is spurted out through the first outlet openings 25 toward the first wash fluid discharging passage 15 is admitted into the large-open inlet openings 15A in an assured manner even though the wash fluid is diffused to some extent after leaving the outlet openings 25. That is to say, a wash fluid which is spurted out through the first outlet openings 25 can be almost entirely supplied onto the outer peripheral surface 8C of the main atomizer body 8 through the wash fluid discharging passage 15.

Figure 6:
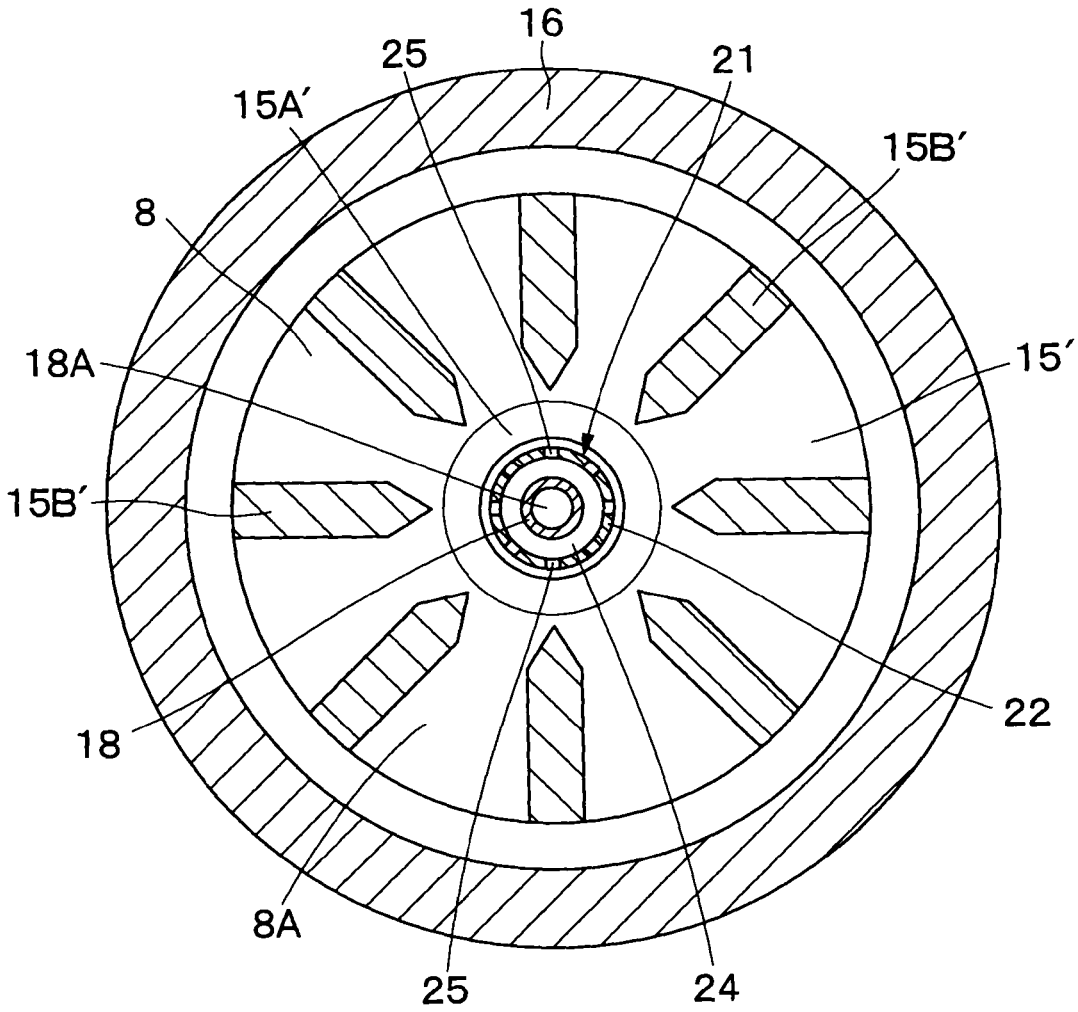
FIG. 6 is an enlarged cross-sectional view of a first modification, taken in a position similar to FIG. 3.

In the case of the first embodiment described above, the main atomizer body 8 is provided with the support members 15B only at the outlet ends of the wash fluid discharging passage 15. However, it is to be understood that the present invention is not limited to a particular example shown. For instance, as in a first modification shown in FIG. 6, the main atomizer body 8 may be provided with support members 15B' which are extended to a point near an inlet opening 15A' of the wash fluid discharging passage 15'. In this case, the support members 15B' are located radially around a nozzle 22 in a center position. Preferably, at the ends on the side of an inlet opening 15A' of the first wash fluid discharging passage 15', the support members 15B' are gradually tapered off to diminish back splashes of the wash fluid.

Figure 7:
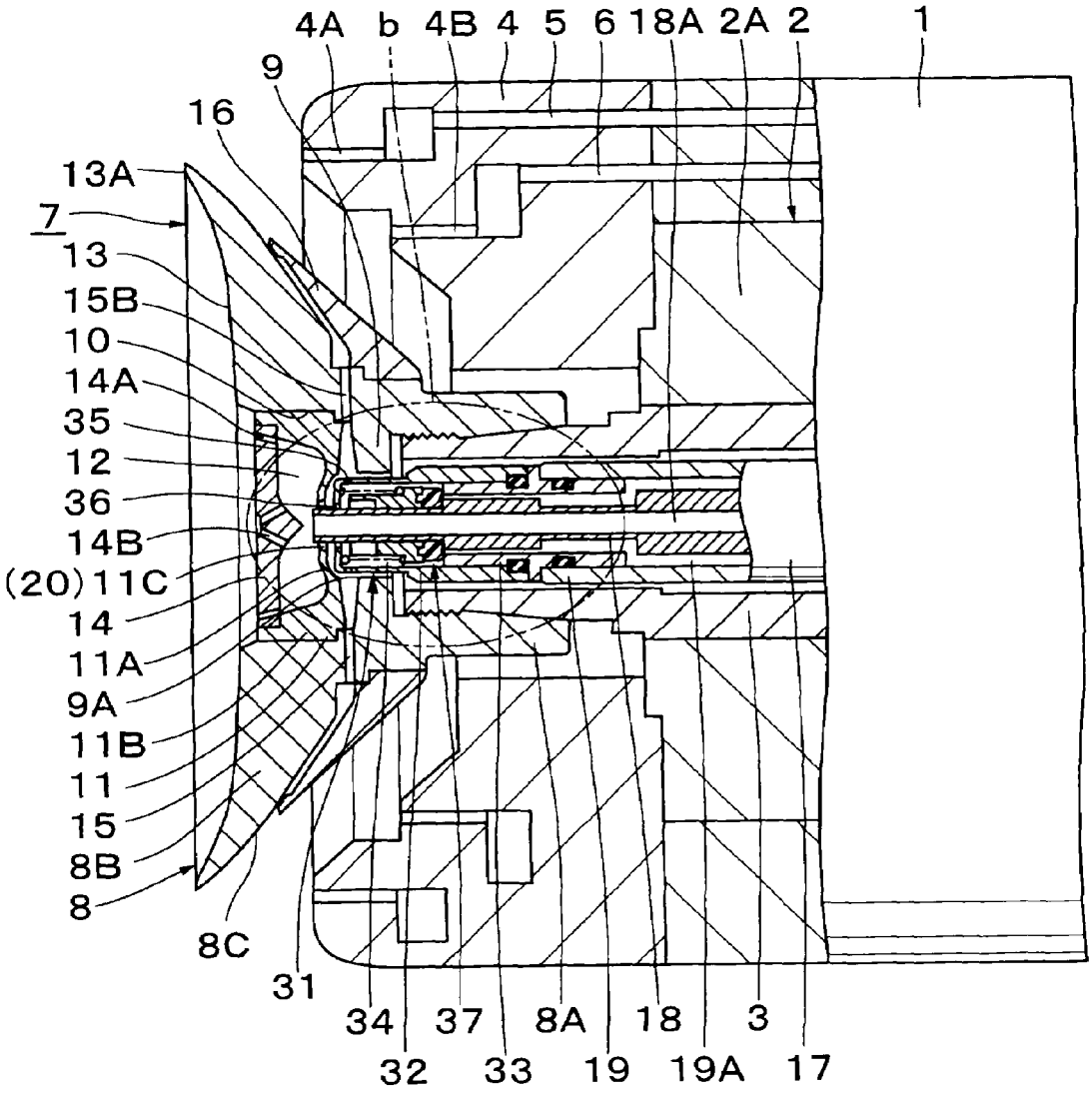
FIG. 7 is a longitudinal sectional view of a rotary atomizing head type coating apparatus according to a second embodiment of the present invention.
Figure 8:
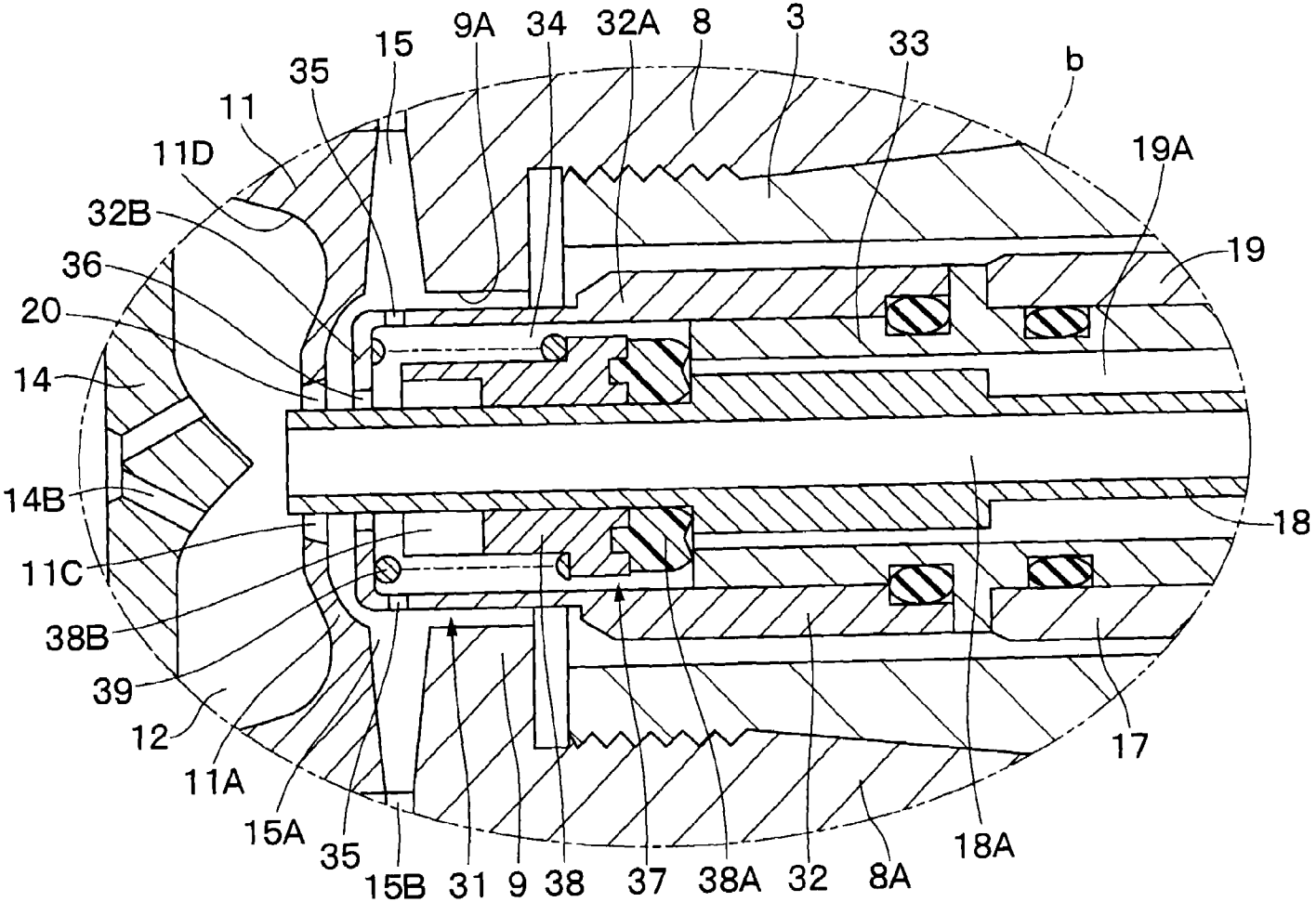
FIG. 8 is a longitudinal sectional view showing an encircled area b in FIG. 7 on an enlarged scale.
Figure 9:
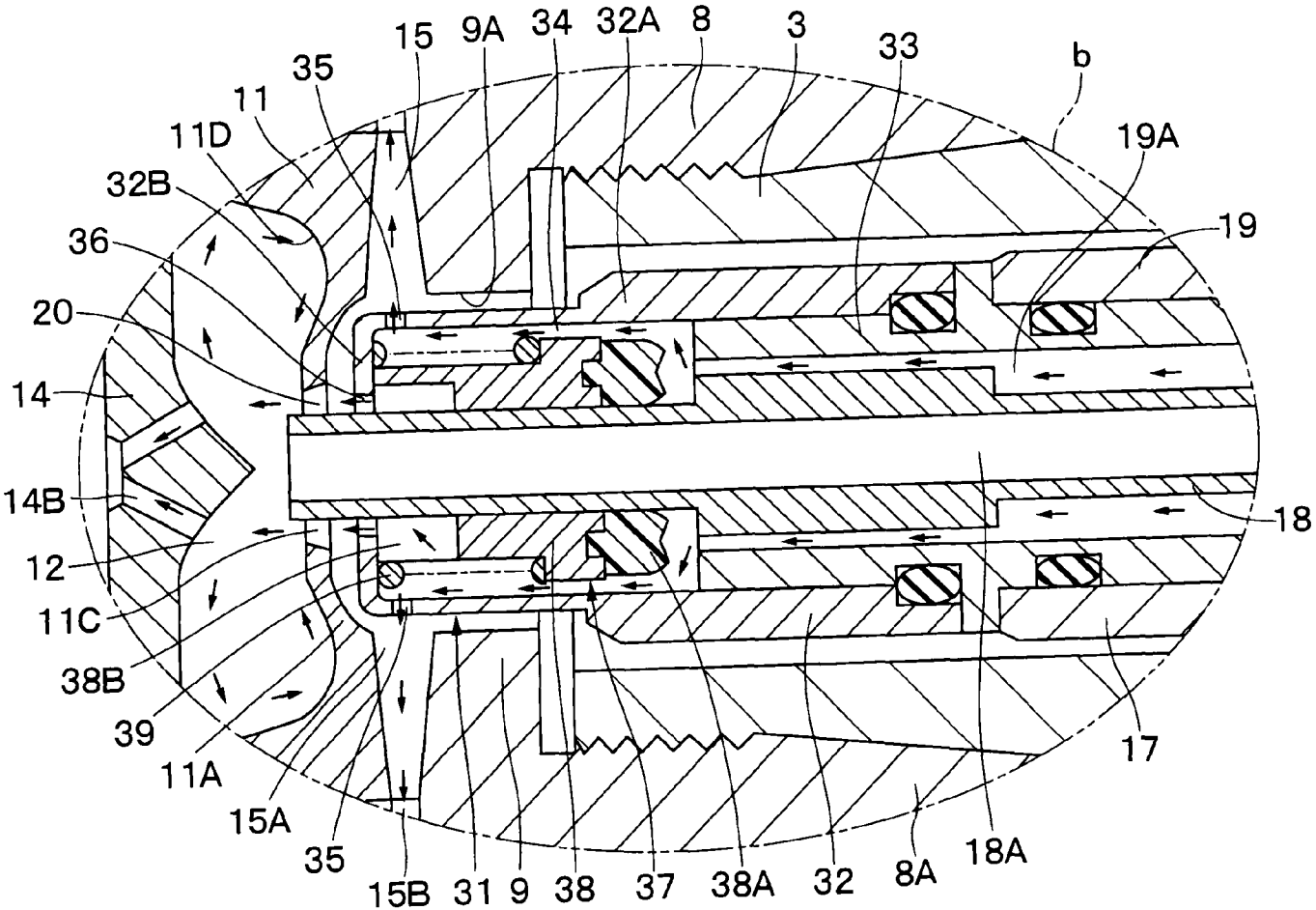
FIG. 9 is a longitudinal sectional view in a position similar to FIG. 8, showing a wash fluid in supply toward a rotary atomizing head.

Now, referring to FIGS. 7 to 9, there is shown a rotary atomizing head type coating apparatus adopted as a second embodiment of the present invention. This embodiment has a feature in that a check valve is constituted by a lid member which closes an outlet end of a wash fluid tube, and a spring which is adapted to bias the lid member toward the outlet end of the wash fluid tube. In the following description of the second embodiment, those component parts which are identical with the counterparts in the foregoing first embodiment are simply designated by the same reference numerals and characters to avoid repetitions of same explanations.

Indicated at 31 is a distribution means which is employed in the second embodiment. This distribution means 31 is composed of a nozzle 32 and first and second outlet openings 35 and 36, which will be described hereinafter. The distribution means 31 is located at an outlet end of a wash fluid tube 19 for the purpose of distributing a wash fluid toward inlet ends of first and second wash fluid discharging passages 15 and 20.

Indicated at 32 is a nozzle which is provided on a fore distal end of the wash fluid tube 19. As shown in FIGS. 7 and 8, the nozzle 32 is formed in a round tubular shape around the outer periphery of the paint tube 18, and attached on fore distal end of the wash fluid tube 19 by the use of a connector member 33. In this instance, extended along inner peripheral side of the connector member 33 is a wash fluid supply passage 19A. Substantially in the same way as the nozzle 22 in the foregoing first embodiment, the nozzle 32 is constituted by an outer peripheral wall portion 32A of a round tubular shape which is extended along the paint tube 18, and a lid portion 32B which is extended radially inward from a fore distal end of the outer peripheral wall portion 32A toward the paint tube 18. Further, an annular chamber 34 is defined internally of the nozzle 32 by an annular space between the outer peripheral wall portion 32A and the paint tube 18.

Further, the nozzle 32 is projected forward from a fore distal end of the rotational shaft 3 and placed in a nozzle receptacle hole 9A which is provided in an inwardly projecting collar 9. The peripheral wall portion 32A of the nozzle 32 is extended as far as a radially confronting position relative to inlet openings 15A of first wash fluid discharging passage 15. On the other hand, the lid portion 32B of the nozzle 32 is located in a spaced position from an annular wall portion 11A of the intermediate tube member 11 (from second wash fluid discharging passage 20), and on the rear side of the wash fluid discharging passage 20.

Denoted at 35 are first outlet openings which are provided in the nozzle 32 at confronting positions relative to the inlet openings 15A of the first wash fluid discharging passage 15. Substantially in the same way as the first outlet openings 25 in the foregoing first embodiment, these plural number of outlet openings 35 are in the form of through holes of a relatively small diameter which are formed through the outer peripheral wall portion 32A at equidistant angular positions around the outer peripheral wall portion 32A. Through the outlet openings 35, a wash fluid in the annular chamber 34 is spurted out toward the wash fluid discharging passage 15.

Indicated at 36 are second outlet openings which are provided in the nozzle 32 at confronting positions relative to the second wash fluid discharging passage 20. Substantially in the same manner as the second outlet openings 26 in the foregoing first embodiment, these second outlet openings 36 are in the form of through holes of a relatively small diameter which are formed through the lid portion 32B at a plural number of positions in marginal edge portions where the lid portion 32B is held in contact with the paint tube 18. More specifically, these outlet openings 36 are provided at equidistant angular positions around the circumference of the paint tube 18 to supply a wash fluid from the annular chamber 34 to a paint reservoir 12 on the rotary atomizing head 7. A wash fluid gushing out of the second outlet openings 36 is allowed to flow along the outer periphery of the paint tube 18 and past the second wash fluid discharging passage 20 for supply to the paint reservoir 12.

Indicated at 37 is a check valve which is provided in the annular chamber 34 of the nozzle 32 to prevent a reverse flow of a wash fluid. As shown in FIGS. 7 and 8, the check valve 37 is constituted by a retainer 38 which is located within the annular chamber 34 to close a fore outlet end of the wash fluid tube 19 as a lid, and a spring member 39 which is interposed between the retainer 38 and the lid portion 32B of the nozzle 32 to bias the retainer 38 toward the fore outlet end of the wash fluid tube 19. In this instance, the retainer 38 is formed in the shape of a tube which surrounds the paint tube 18, and a seal member 38A is attached to rear end of the retainer 38 to close the fore outlet end of the wash fluid tube 19 in a sealed state. The seal member 38A is formed in an annular shape by the use of a synthetic resin material, and normally pressed against fore end of the connector member 33 together with the retainer 38.

On the other hand, provided at a front side of the retainer 38 is a passage 38B to lead a wash fluid in the annular chamber 34 toward the second outlet openings 36. This passage 38B is formed, for example, by partly recessing front end of the retainer 38. By way of the passage 38B, the annular chamber 34 is communicated with the second outlet openings 36 even when the retainer 38 is abutted against the lid portion 32B of the nozzle 32.

Normally, the retainer 38 of the check valve 37 is pressed against the fore end face of the connector member 33 by the spring member 39 to close the fore outlet end of the wash fluid tube 19. At this time, the seal member 38A is resiliently pressed against front end face of the connector member 33 to prevent leakage of a wash fluid. On the other hand, when a wash fluid is supplied through the wash fluid tube 19, the retainer 38 is displaced toward the lid portion 32B of the nozzle 32 by the pressure of the supplied wash fluid against the biasing force of the spring member 39. As a result, the seal member 38A is disengaged from the front end face of the connector member 33. Thus, the check valve 37 is normally closed, and opened as soon as a wash fluid is supplied.

Thus, this embodiment can produce substantially the same operational effects as the foregoing first embodiment. Especially in the case of the present embodiment, the check valve 37 is constituted by the retainer 38 and the spring member 39. Therefore, the outlet end of the wash fluid tube 19 which is normally closed by the retainer 38 is opened as soon as a wash fluid is supplied, displacing the retainer 38 against the spring member 39. Thus, the check valve 37 is opened and closed according to the pressure of a supplied wash fluid, maintaining the pressure in the annular chamber 34 at a sufficiently high level for spurting the wash fluid out through the first and second outlet openings 35 and 36 by the pressure of the supplied wash fluid.

Figure 10:
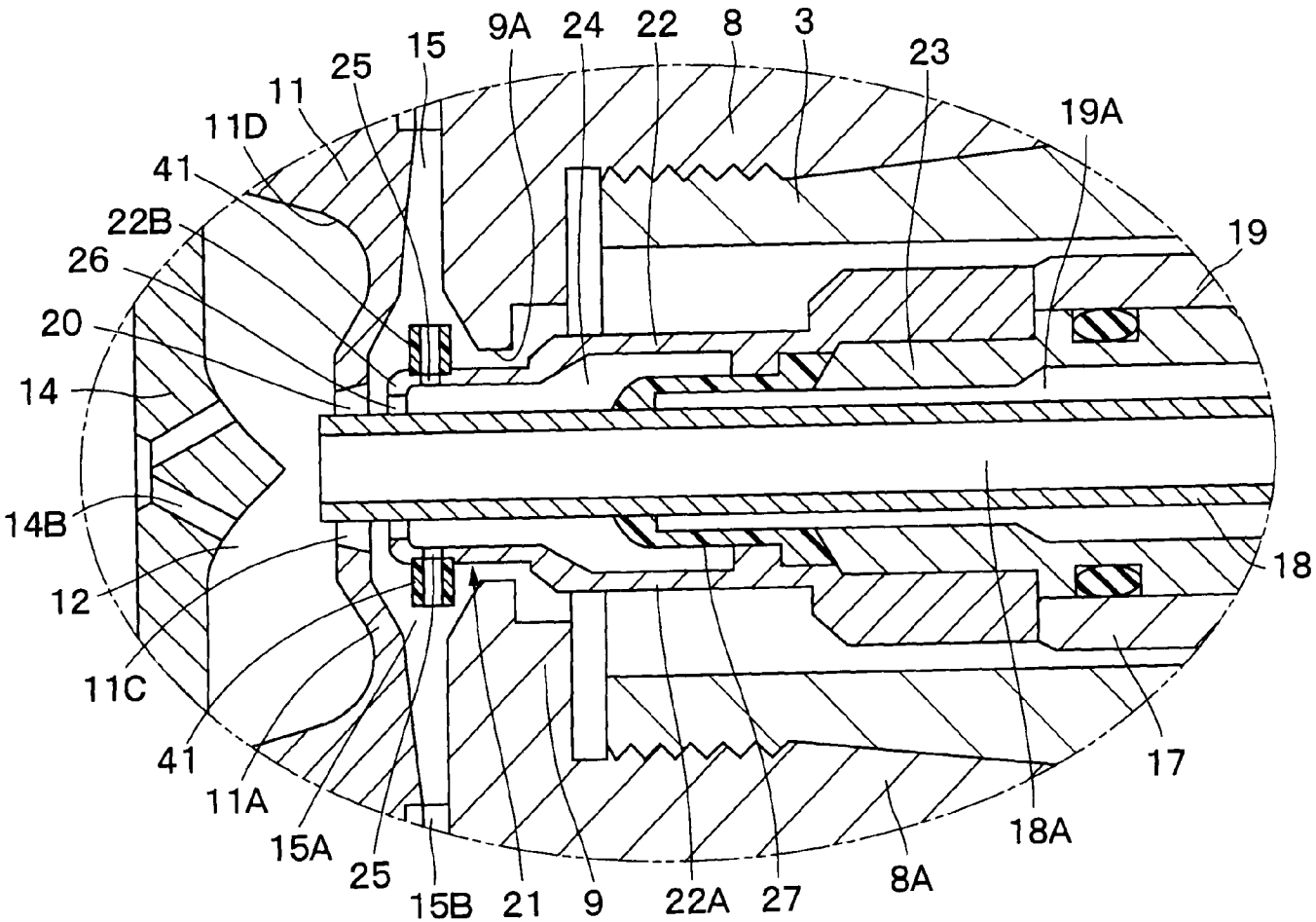
FIG. 10 is a longitudinal sectional view of a rotary atomizing head type coating apparatus according to a third embodiment of the present invention, taken in a position similar to FIG. 2.
Figure 11:
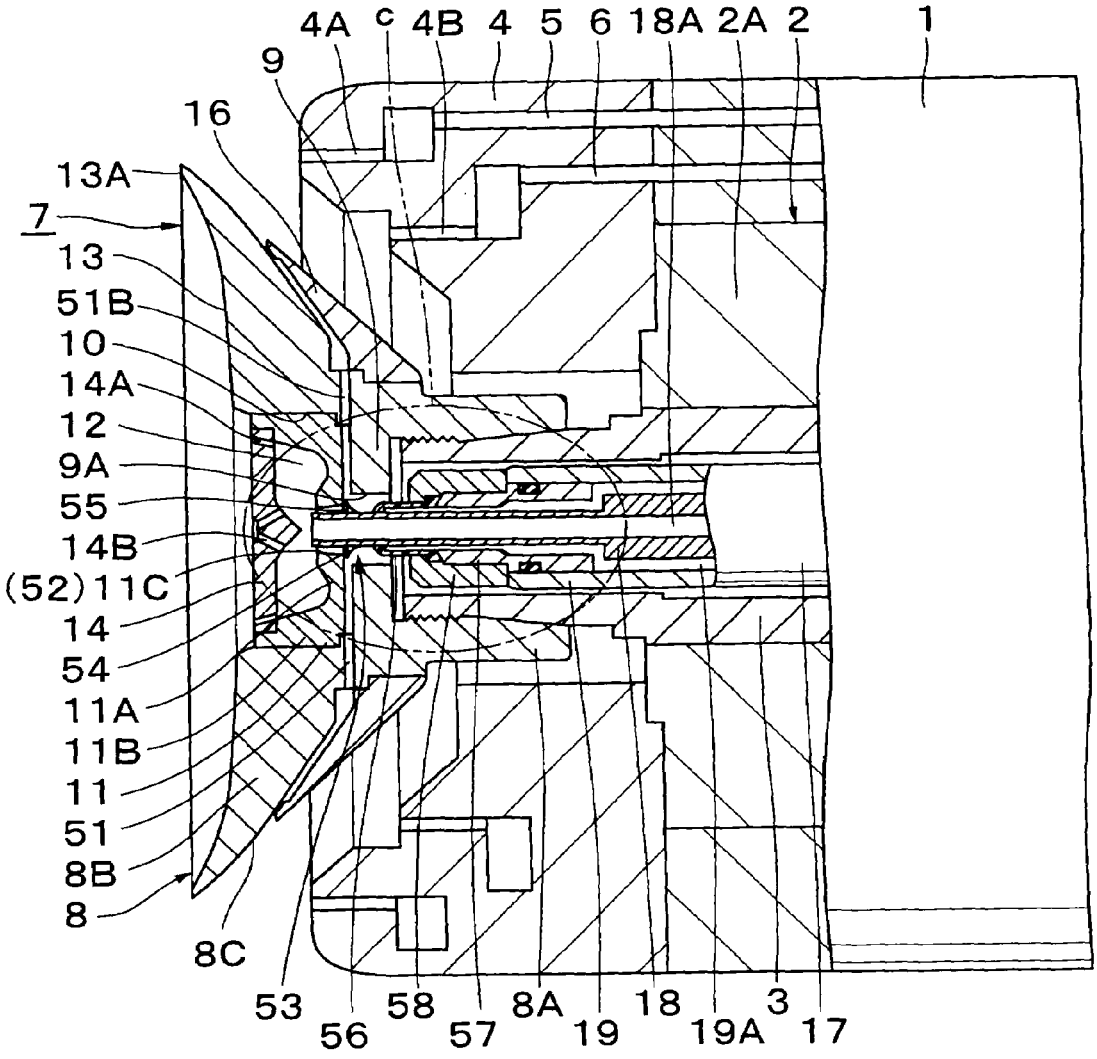
FIG. 11 is a longitudinal sectional view of a rotary atomizing head type coating apparatus according to a fourth embodiment of the present invention.

Now, turning to FIG. 10, there is shown a rotary atomizing head type coating apparatus adopted as a third embodiment of the present invention. This embodiment has a feature in that branch nozzles are attached to first outlet openings, with outer ends of the branch nozzles placed in inlet openings of wash fluid discharging passages. In the following description of the third embodiment, those component parts which are identical with the counterparts in the foregoing first embodiment are simply designated by the same reference numerals or characters to avoid repetitions of same explanations.

Indicated at 41 are branch nozzles which are provided respectively on the first outlet opening 25 and formed in a tubular shape by the use of a solvent- and chemical-resisting elastic material. A base end of each branch nozzle 41 is attached to the nozzle 22 in such a way as to circumvent an outlet opening 25, while an outer end of the branch nozzle 41 is placed in an inlet opening 15A of a first wash fluid discharging passage 15. Thus, the branch nozzles 41 function to hand over a wash fluid from the nozzle 22 of the feed tube 17 to the first wash fluid discharging passage 15 of the rotary atomizing head 7 in an assured manner.

The branch nozzles 41 are formed of a elastic material, so that they can easily deform their fore end, for example, when they are brought into contact with the inwardly projecting collar 9 of the rotary atomizing head 7 when threading (mounting) the rotary atomizing head 7 on the rotational shaft 3. That is to say, the rotary atomizing head 7 can be mounted on the rotational shaft 3 without hindered by the branch nozzles 41.

Thus, this embodiment can produce substantially the same operational effects as the foregoing first embodiment. Especially in the case of the present embodiment, the branch nozzles 41 are extended out from the first outlet openings 25 toward inlet openings of the first wash fluid discharging passage 15. Therefore, an effluent wash fluid from the first outlet openings 25 are led to a wash fluid discharging passage 15 through the branch nozzles 41 in an assured manner. That is, an effluent wash fluid from the first outlet openings 25 can be almost entirely supplied to the outer peripheral surface 8C of the main atomizer body 8 through the wash fluid discharging passage 15.

In the third embodiment, the branch nozzles 41 are attached to a rotary atomizing head type coating apparatus as described as a first embodiment of the invention. However, needless to say, for example, the branch nozzles 41 may be attached to a rotary atomizing head type coating apparatus of a construction similar to the second embodiment.

Further, in the third embodiment, the branch nozzles 41 are attached separately to a plural number of outlet openings 25. However, the present invention is not limited to this particular example shown. For instance, a couple of collar rings may be fitted on the outer periphery of the nozzle 22 in axially spaced positions on the opposite sides of the first outlet openings 25.

Now, turning to FIGS. 11 to 14, there is shown a rotary atomizing head type coating apparatus adopted as a fourth embodiment of the present invention. This embodiment has a feature in that a distribution means is constituted by a fin wall member provided around the paint tube for turning a flow direction of a wash fluid toward first wash fluid discharging passage, and through holes which are provided in the fin wall member to conduct the wash fluid toward second outlet openings. In the following description of the fourth embodiment, those component parts which are identical with the counterparts in the foregoing first embodiment are simply designated by the same reference numerals or characters to avoid repetitions of same explanations.

Indicated at 51 is first wash fluid discharging passage which is provided on a main atomizer body 8. Substantially in the same way as the wash fluid discharging passage 15 in the first embodiment, the wash fluid discharging passage 51 has an inlet end opened behind a paint reservoir 12 and an outlet end opened toward an outer peripheral surface 8C of the main atomizer body 8. Further, for example, the wash fluid discharging passage 51 is in the form of an annular gap space which is opened between a mount base 8A (an inwardly projecting collar 9) and a flared bell portion 8B (an intermediate tube member 11) of the rotary atomizing head 7.

In this instance, the inlet opening 51A of the wash fluid discharging passage 51 is arranged to circumvent the paint tube 18 and opened all around. Further, the annular wall portion 11A of the intermediate tube member 11 is provided with a substantially plane surface on the rear side, so that the wash fluid discharging passage 51 has an almost constant gap width in the axial direction between the mount base 8A and the flared bell portion 8B. By the annular wall portion 11A, the wash fluid discharging passage 51 is partitioned off from the paint reservoir 12 to let a wash fluid from the wash fluid tube 19 flow out onto the outer peripheral surface 8C of the main atomizer body 8.

Further, provided on the outlet side of the wash fluid discharging passage 51 is a plural number of support members 51B between the mount base 8A and the flared bell portion 8B. These support members 51B are located at uniform intervals in the circumferential direction. In this manner, an axial gap width of the wash fluid discharging passage 51 is secured and maintained by the support members 51B internally of the main atomizer body 8.

Indicated at 52 is a second wash fluid discharging passage which is provided on the main atomizer body 8. Substantially in the same way as the wash fluid discharging passage 20 in the foregoing first embodiment, the wash fluid discharging passage 52 is constituted by an annular passage which is defined between the paint tube 18 and the tube receptacle hole 11C of the intermediate tube member 11. An inlet end of the wash fluid discharging passage 52 is opened to the rear side of the intermediate tube member 11 (on the side of the inlet opening 51A of the first wash fluid discharging passage 51). Namely, the wash fluid discharging passage 52 has its inlet end opened on the rear side of the paint reservoir 12 and its outlet end opened into the paint reservoir 12. Further, the wash fluid discharging passage 52 is gradually narrowed down from its inlet to outlet end in a tapered shape.

Denoted at 53 is a distribution means adopted in the fourth embodiment. This distribution means 53 is constituted by a fin member 54 with axial through holes 55, which will be described hereinafter. The distribution means 53 functions to distribute a wash fluid from the wash fluid tube 19 to inlet ends of the first and second wash fluid discharging passages 51 and 52.

Indicated at 54 is a fin member which is fixedly provided on a fore end portion of the paint tube 18. This fin member 54 is located in a confronting position relative to a check valve 56 which will be described hereinafter. Further, the fin member 54 is formed substantially in the shape of a round tapered ring and fixed around a fore end portion of the paint tube 18 while circumventing the outer peripheral side of the paint tube 18.

More specifically, the fin member 54 is mounted on the paint tube 18 at a position spaced from the annular wall portion 11A of the intermediate tube member 11 and placed on the rear side than the wash fluid discharging passage 52, in radially confronting relation with the first wash fluid discharge passage 51. Further, the fin member 54 has an outside diameter larger than that of the opening at the inlet end (at the rear end) of the second wash fluid discharging passage 52. Furthermore, the fin member 54 is gradually tapered in forward and radially outward directions to turn an axial flow of a wash fluid, coming through the wash fluid tube 19 and the check valve 56, into a radially outward direction toward the first wash fluid discharging passage 51.

Figure 12:
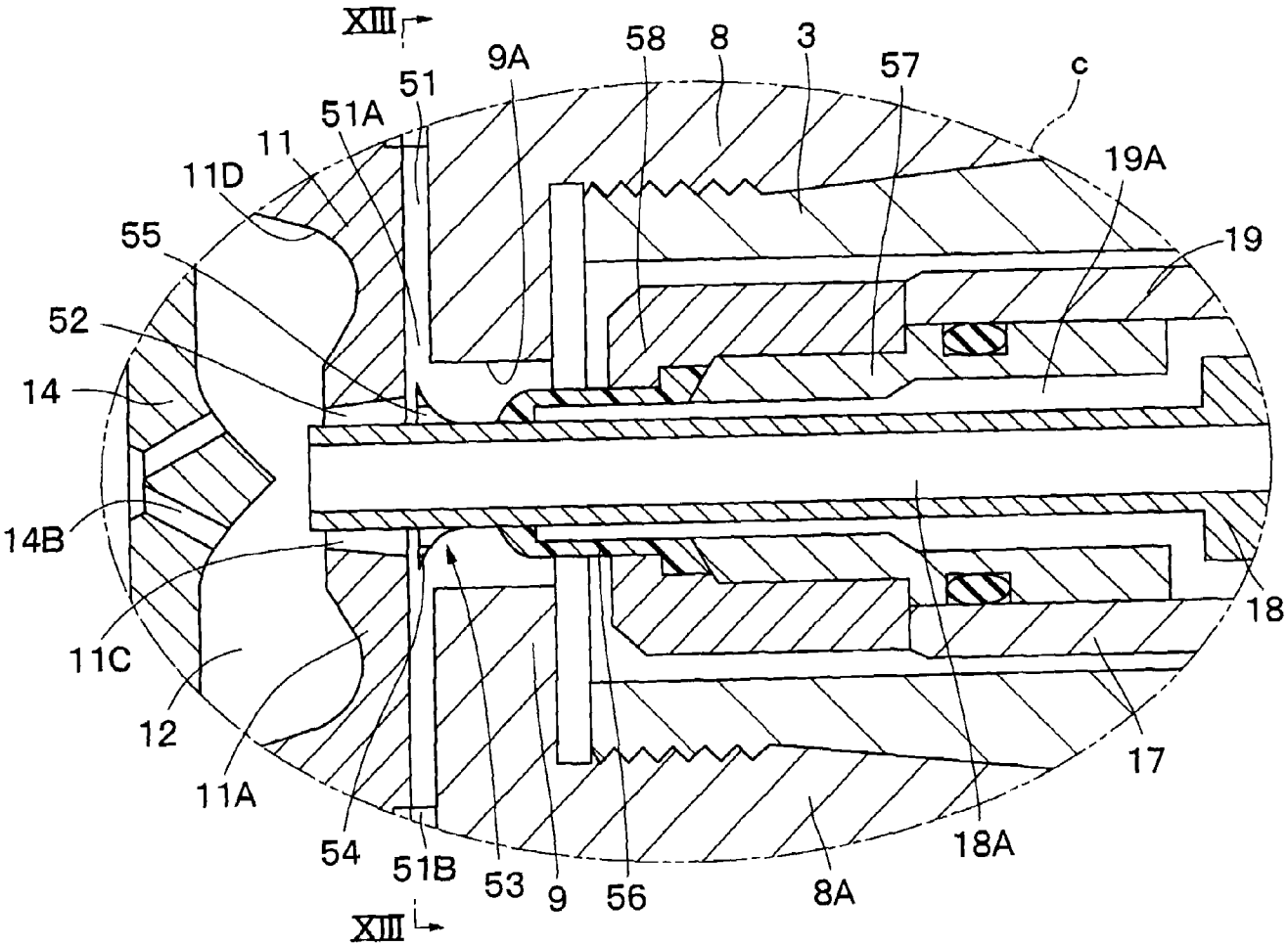
FIG. 12 is a longitudinal sectional view showing an encircled area c in FIG. 11 on an enlarged scale.
Figure 13:
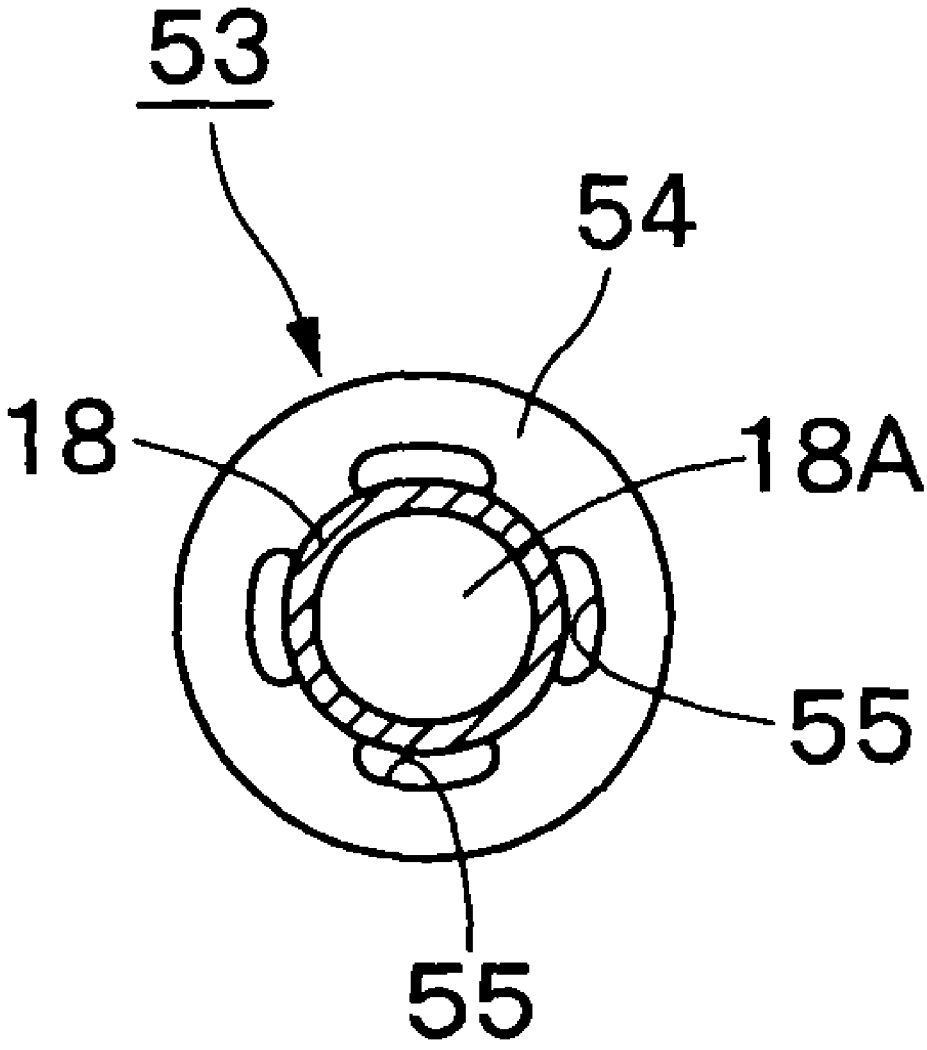
FIG. 13 is an enlarged cross-sectional view taken from the direction of arrows XIII-XIII of FIG. 12.
Figure 14:
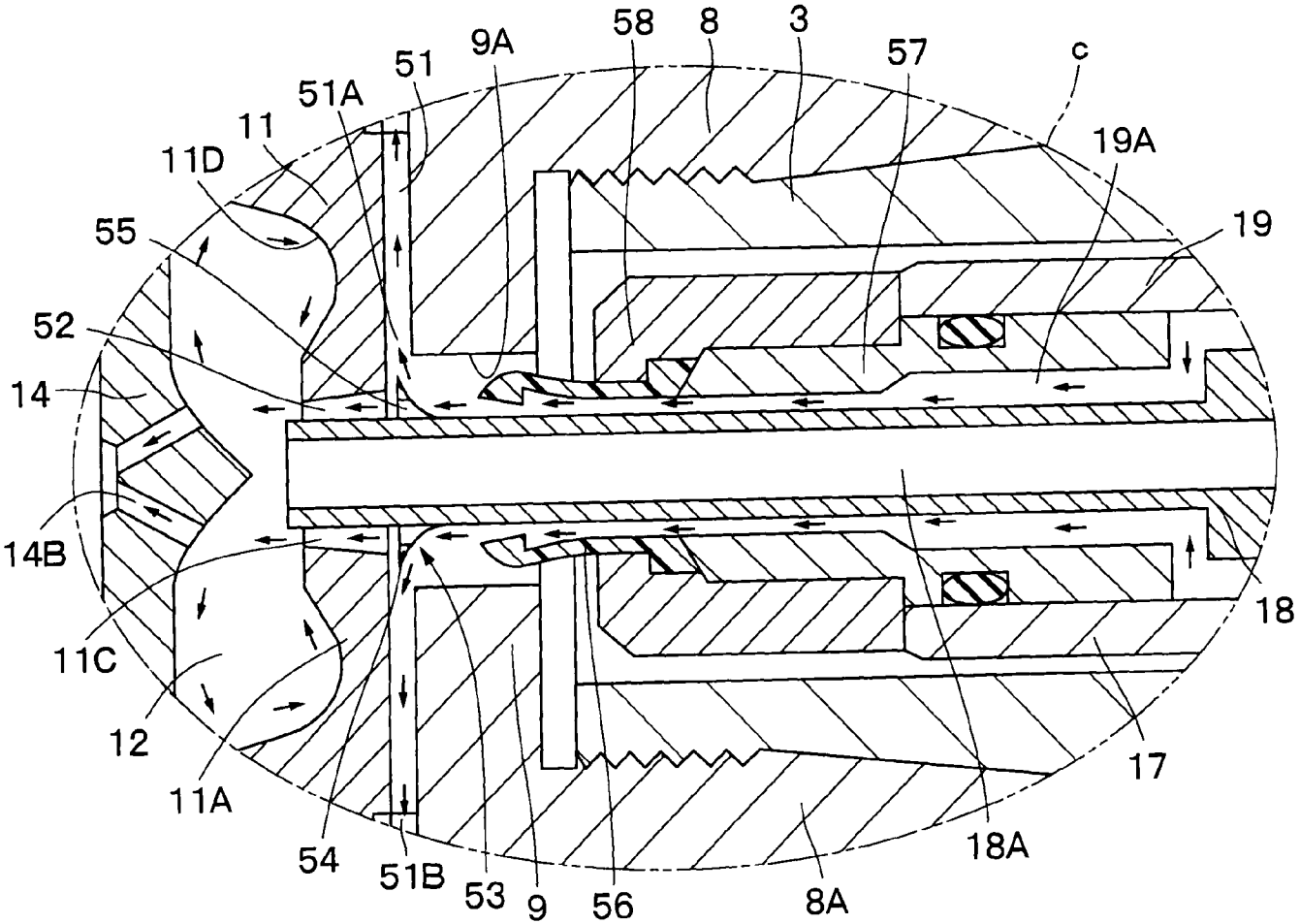
FIG. 14 is a longitudinal sectional view in a position similar to FIG. 12, showing a wash fluid in supply toward a rotary atomizing head.

Designated at 55 are through holes which are bored in the fin member 54 at confronting positions relative to the second wash fluid discharging passage 52. As shown in FIGS. 12 and 13, the fin member 54 is provided with a plural number of through holes (e.g., four through holes) 55 of a small diameter at uniformly spaced angular positions around the circumference of the paint tube 18. By way of these through holes 55, part of the wash fluid from the wash fluid tube 19 is distributed toward the paint reservoir 12 of the rotary atomizing head 7. An effluent wash fluid from the through holes 55 is allowed to flow along the outer periphery of the paint tube 18 past the second wash fluid discharging passage 52 for supply to the paint reservoir 12.

Indicated at 56 is a check valve which is provided at an outlet end of the wash fluid tube 19 to prevent a reverse flow of a wash fluid. This check valve 56 is attached to a fore outlet end of the wash fluid tube 19 by the use of a connector member 57 which is provided on a fore end portion of the wash fluid tube 19, and a fixing ring 58 which is fitted around the connector member 57 in a fore side portion of the latter. Substantially in the same way as the check valve 27 in the first embodiment, the check valve 56 is formed substantially in a tubular shape by the use of a elastic material, for example, by the use of a fluorine-base resin, and fixed in position around the paint tube 18.

In this instance, at a base end side, the check valve 56 is communicated with the wash fluid tube 19 (with the wash fluid supply passage 19A) to receive a supply of a wash fluid therefrom. On the other hand, at a front end side, the check valve 56 is normally held in abutting engagement with an outer peripheral surface of the paint tube 18 to prevent leaks of a wash fluid. However, upon receipt of a supply of a wash fluid from the wash fluid tube 19, the fore end of the check valve 56 is disengaged from the paint tube 18 through elastic deformation under the pressure of the supplied wash fluid. Thus, the check valve 56 is normally closed, and opened as soon as a wash fluid is supplied thereto.

The present embodiment can produce substantially the same operational effects as the foregoing first embodiment. Especially, in the case of the present embodiment, the distribution means 53 is constituted by the fin member 54 and the through holes 55. Thus, distribution means 53 let part of the wash fluid from the wash fluid tube 19 turn toward the first wash fluid discharging passage 51 by use of the fin member 54, and the remainder of the wash fluid supply toward the second wash fluid discharging passage 52 through the axial through holes 55.

Besides, the check valve 56 is provided at an outlet end of the wash fluid tube 19, at a position behind the fin member 54, thereby preventing a wash fluid from leaking from the wash fluid tube 19 and dripping on a work piece during a coating operation. Furthermore, since the check valve 56 can be opened by the pressure of a supplied wash fluid, an effluent wash fluid from the wash fluid tube 19 can be hit against the fin member 54 with a sufficient pressure for letting the wash fluid jump into the first wash fluid discharging passage 51 across a gap space between the fin member 54 and the wash fluid discharging passage 51. Thus, the wash fluid can be supplied to the first wash fluid discharging passage 51 securely in an assured manner.

Figure 15:
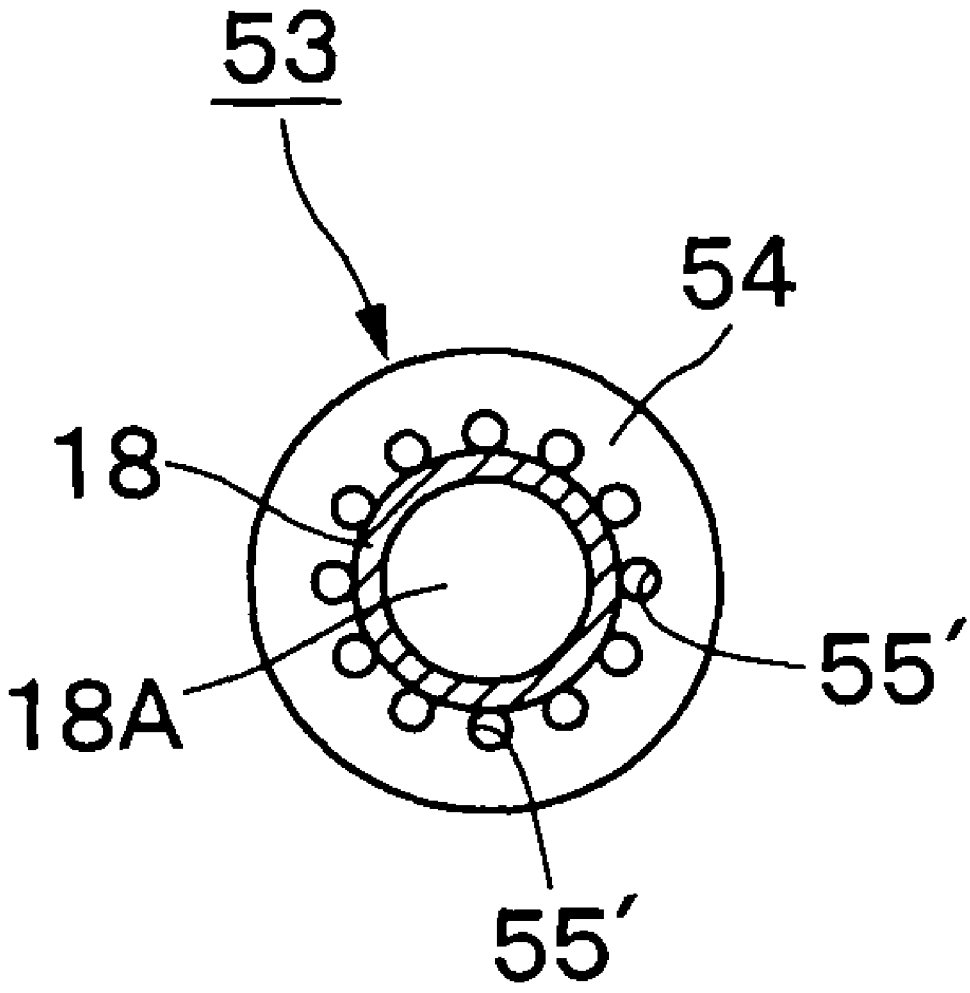
FIG. 15 is an enlarged cross-sectional view in a position similar to FIG. 13, showing a fin member in a second modification.

In the fourth embodiment described above, four axial through holes 55 are bored in the fin member 54. However, more than four axial through holes 55' (e.g., 12 through holes) may be bored in the fin member 54 as in a second modification shown in FIG. 15. Alternatively, if desired, there may be employed a fin member with one to three through holes.

Figure 16:
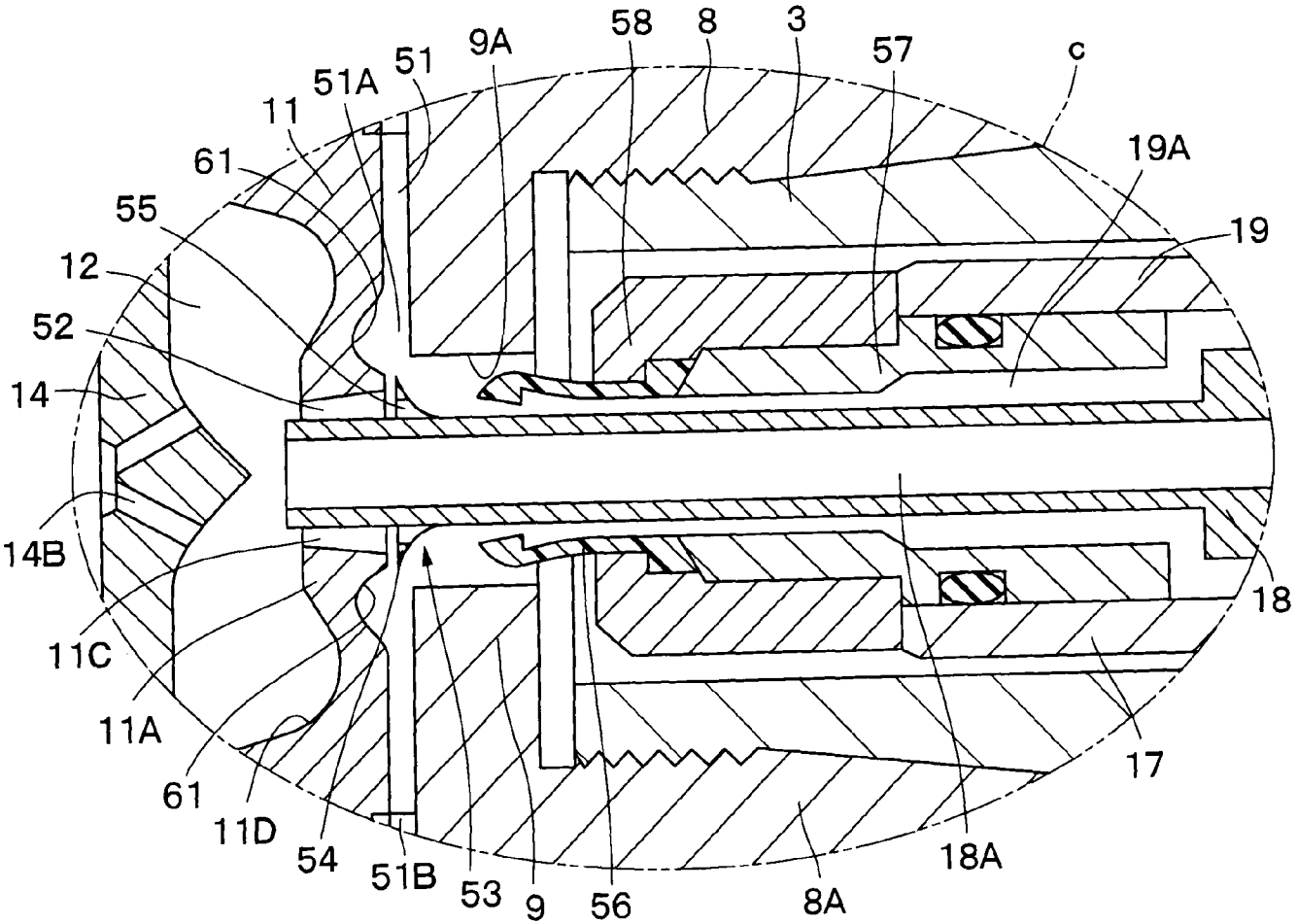
FIG. 16 is a longitudinal sectional view in a position similar to FIG. 12, showing a rotary atomizing head type coating apparatus of a third modification.

Further, in the fourth embodiment described above, a substantially flat plane surface is provided on the rear side of the annular wall portion 11A which partitions off the paint reservoir 12 from the wash fluid discharging passage 51. However, as in a third modification shown in FIG. 16, the back side of the annular wall portion 11A of the intermediate tube member 11 may be recessed toward the fore side of the rotary atomizing head 7 to provide a recessed passage way 61 around the fin member 54.

In this instance, awash fluid which is hit against the annular wall portion 11A after being turned by the fin member 54 can be received in the recessed passage way 61. Therefore, the wash fluid is prevented from scattering around upon hitting the annular wall portion 11A, and the wash fluid received in the recessed passage way 61 can be led to the first wash fluid discharging passage 51.

Figure 17:
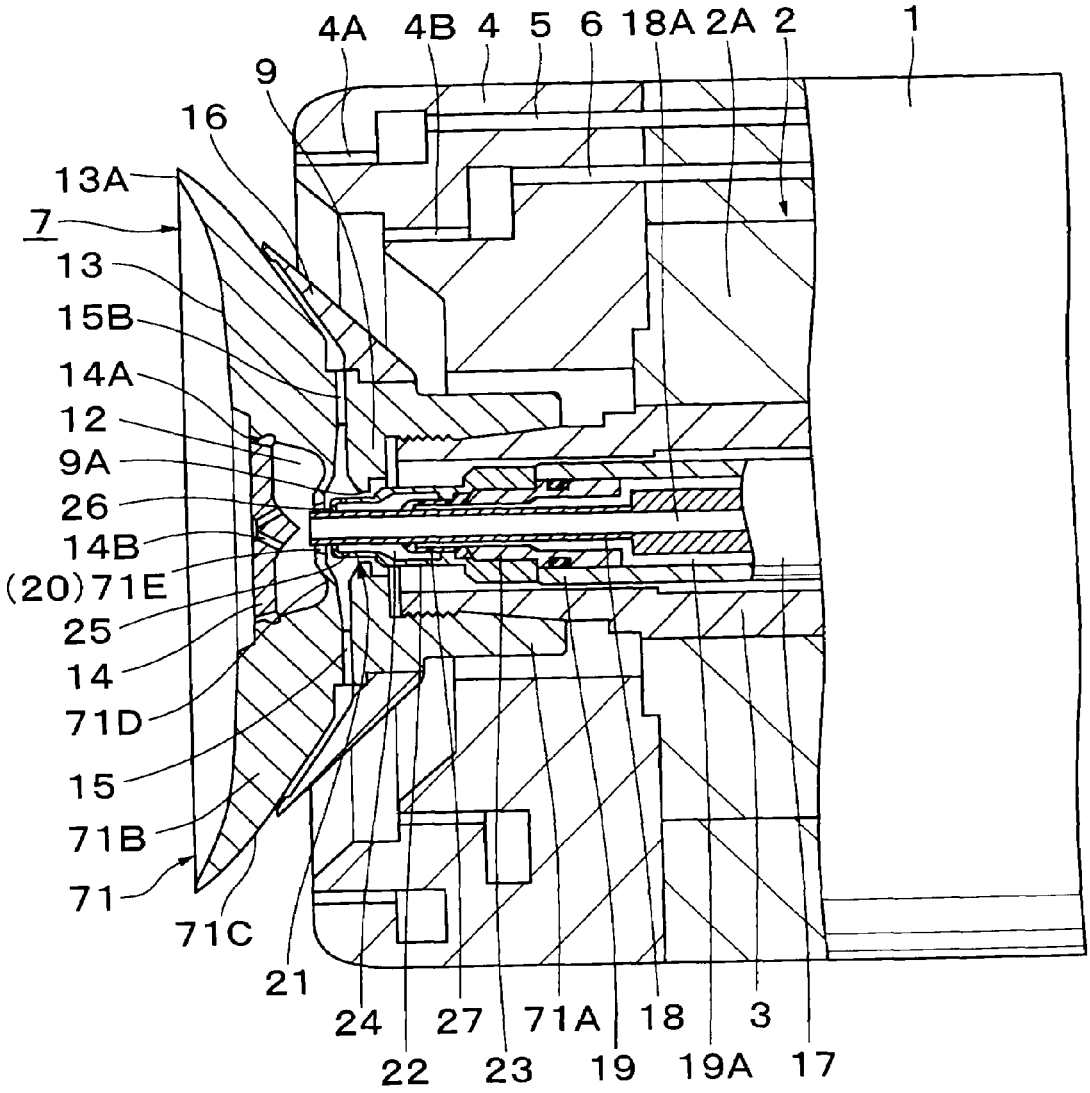
FIG. 17 is a longitudinal sectional view in a position similar to FIG. 1, showing a rotary atomizing head type coating apparatus of a fourth modification.

Further, in the foregoing embodiments, the intermediate tube member 11 is mounted on the inner peripheral side of the main atomizer body 8 to define the paint reservoir 12 therein. However, as in a fourth modification shown in FIG. 17, a main atomizer body 71 may be so arranged as to define a paint reservoir 12 directly on its inner peripheral side without using an intermediate tube. In this case, the main atomizer body 71 has a mount base 71A, a flared bell portion 71B and an outer peripheral surface 71C, along with an annular wall portion 71D and a tube receptacle hole 71E.

Figure 18:
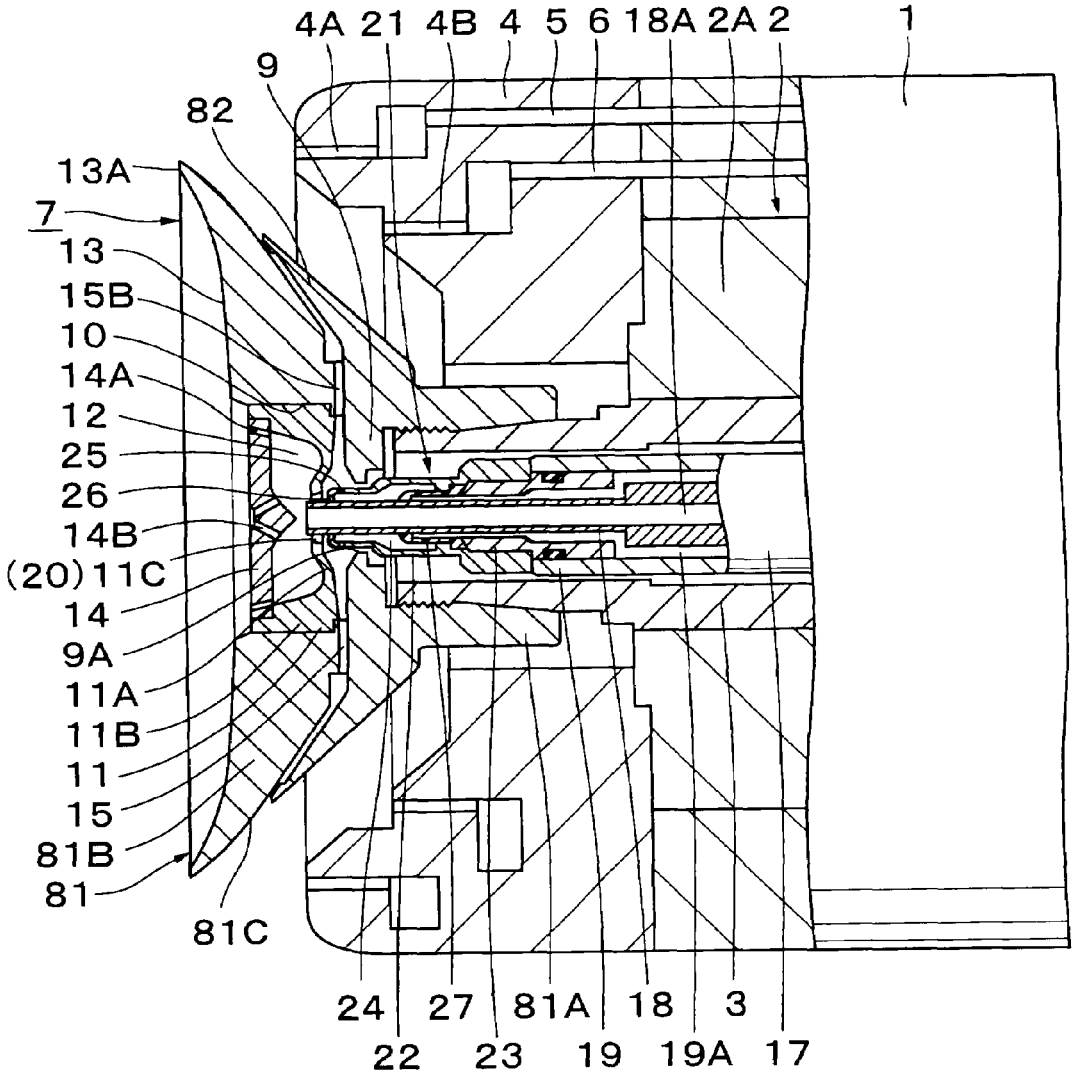
FIG. 18 is a longitudinal sectional view in a position similar to FIG. 1, showing a rotary atomizing head type coating apparatus of a fifth modification according to the present invention.

Furthermore, in the foregoing embodiments, the main atomizer body 8 and the annular guide 16 are shown as separate parts. However, as in a fifth modification shown in FIG. 18, an annular guide 82 may be provided as an integral part of a main atomizer body 81 if desired. In this case, the main atomizer body 81 has a mount base 81A, a flared bell portion 81B and an outer peripheral surface 81C.

Moreover, in the foregoing embodiments, the paint tube 18 and the wash fluid tube 19 are provided by the use of a coaxial double tube construction. However, the present invention is not limited to this particular example. For example, a paint tube and a wash fluid tube may be formed by the use of two separate tubes which are extended side by side in parallel relation with each other.

The invention claimed is:

1. A rotary atomizing head type coating apparatus comprising:

a hollow rotational shaft driven by a motor;

a main atomizer body of a bell or a cup shape having a mount base at a rear side to be mounted on said rotational shaft, a paint reservoir at a depth from a front side and a paint spreading surface provided in a front side of said paint reservoir for spreading paint into the shape of a thin film;

a partition member located on an inner peripheral side of said main atomizer body to partition off said paint reservoir from said paint spreading surface, and including paint outlet holes to let paint in said paint reservoir flow out therethrough toward said paint spreading surface; and a paint tube passed through said rotational shaft and having an outlet end opened into said paint reservoir to supply paint thereto;

a first wash fluid discharging passage provided at said main atomizer body and including an inlet end opened at the rear side of said paint reservoir and an outlet end opened at a back side of said main atomizer body;

a second wash fluid discharging passage provided at said main atomizer body and including an inlet end opened at the rear side of said paint reservoir and an outlet end opened into said paint reservoir;

a wash fluid tube extended side by side with said paint tube to supply a wash fluid toward said first wash fluid discharging passage and said second wash fluid discharging passage;

distribution means provided at an outlet end of said wash fluid tube for distributing a wash fluid toward inlet ends of said first wash fluid discharging passage and said second wash fluid discharging passage;

said distribution means including a fin wall member fitted on said paint tube to turn a flow direction of an effluent wash fluid from said wash fluid tube toward said first wash fluid discharging passage, and axial through holes bored in said fin wall member to conduct an effluent wash fluid from said wash fluid tube toward said second wash fluid discharging passage; and said wash fluid tube including a check valve at an outlet end at a position behind said fin wall member to prevent a reverse flow of said wash fluid.

2. A rotary atomizing head type coating apparatus as defined in claim 1, wherein:

said main atomizer body includes a partition wall to partition off said paint reservoir from said first wash fluid discharging passage; and said partition wall including a recessed passage way on the back side thereof and in a radially outer position relative to said fin wall member thereby to guide a flow of a wash fluid toward said first wash fluid discharging passage after a turn along said fin wall member.

3. A rotary atomizing head type coating apparatus as defined in claim 1, further comprising:

a partition wall on said main atomizer body to partition off said first wash fluid discharging passage from said paint reservoir;

a paint tube receptacle hole provided in said partition wall to receive said paint tube therein; and said second wash fluid discharging passage being formed as an annular passage between said paint tube and said paint tube receptacle hole.

4. A rotary atomizing head type coating apparatus as defined in claim 1, wherein:

said wash fluid tube is provided coaxially around outer periphery of said paint tube; and said distribution means is located at a fore outlet end of said wash fluid tube and around outer periphery of said paint tube.

5. A rotary atomizing head type coating apparatus as defined in claim 1, wherein said check valve is formed of an elastic material and adapted to normally close an outlet end of said wash fluid tube and to open said outlet end through elastic deformation upon supply of a wash fluid.

* * * * *